US005458482A

United States Patent [19]

Saito et al.

[11] Patent Number: 5,458,482

[45] Date of Patent: Oct. 17, 1995

[54] GAS LIGHTER WITH SAFETY DEVICE

[75] Inventors: Masaki Saito; Toshihiro Ichikawa, both of Shizuoka, Japan

[73] Assignee: Tokai Corporation, Shizuoka, Japan

[21] Appl. No.: 297,697

[22] Filed: Aug. 29, 1994

[30] Foreign Application Priority Data

Mar. 3, 1994 [JP] Japan ..... 6-033856
Jun. 30, 1994 [JP] Japan ..... 6-149613

[51] Int. Cl.[6] ..... F23D 11/36

[52] U.S. Cl. ..... 431/153; 431/255

[58] Field of Search ..... 431/255, 153, 431/277, 276

[56] References Cited

U.S. PATENT DOCUMENTS 3,898,031 8/1975 Rusakowicz .
4,784,602 11/1988 Nitta .
4,786,248 11/1988 Nitta .
4,830,603 5/1989 Cirami ..... 431/277 X
4,832,596 5/1989 Morris, Sr. .
4,859,172 8/1989 Nitta .
4,904,180 2/1990 Nitta .
4,921,420 5/1990 Johnston ..... 431/153
5,002,482 3/1991 Fairbanks .
5,186,618 2/1993 Shike et al. ..... 431/153
5,205,729 4/1993 Iwahori ..... 431/153
5,228,849 7/1993 Frigiere ..... 431/153
5,240,408 8/1993 Kenjiro et al. ..... 431/277 X

FOREIGN PATENT DOCUMENTS 3-25215 3/1991 Japan .
3-35971 3/1991 Japan .
3-501647 3/1991 Japan .

*Primary Examiner*—Carl D. Price
*Attorney, Agent, or Firm*—Brumbaugh, Graves, Donohue & Raymond

[57] ABSTRACT

A gas lighter with a safety device is provided with a resilient leaf which can be deformed between a locked state in which the depression of a pressing means is prevented and a lock-released state in which the operation of the pressing means is allowed, and a slide member which is fitted around the resilient leaf and is movable between a first position where ignition operation is impracticable when the resilient leaf is in a locked state and a second position where the ignition operation is practicable. The slide member deforms the resilient leaf and renders it in a lock-released state at a third position which is reached during movement from the second position to the first position in response to ignition operation. The gas lighter is also provided with a deformation suppressing means for reducing the amount of deformation of the resilient leaf obtained when the slide member is located at the second position so as to be less than the amount of deformation of the resilient leaf in a lock-released state when the slide member is located at the third position.

13 Claims, 17 Drawing Sheets

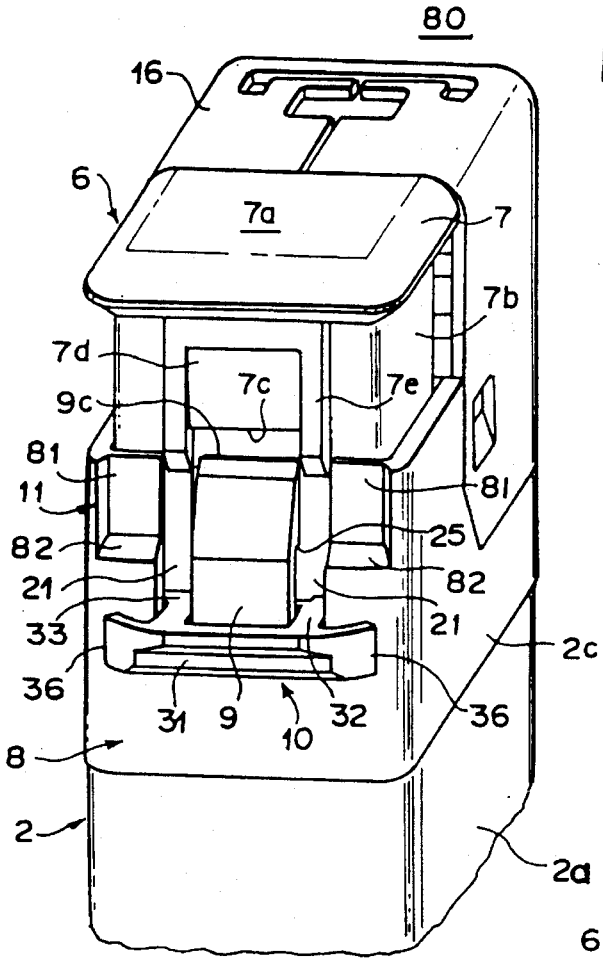
FIG.13A
FIG.13B
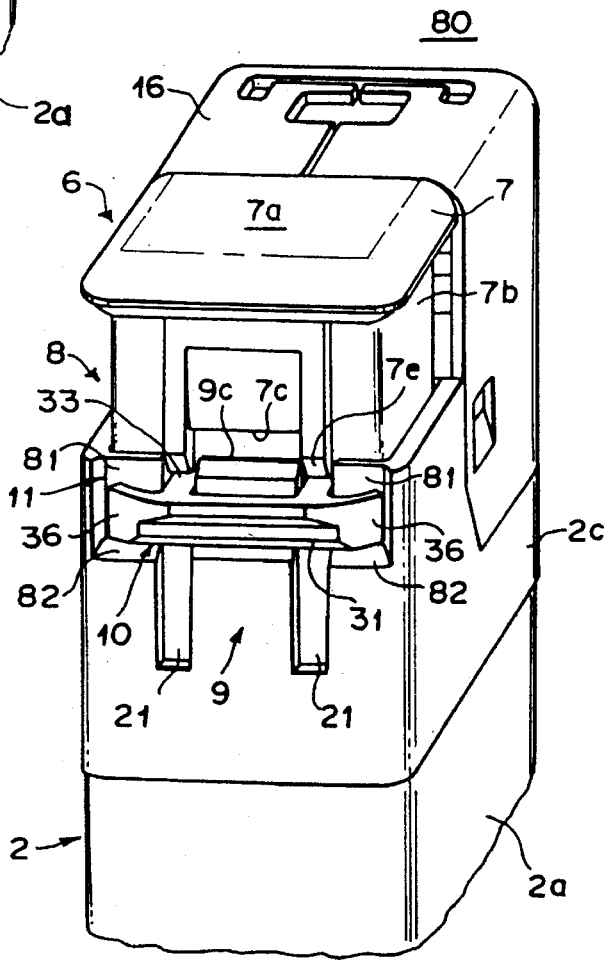

GAS LIGHTER WITH SAFETY DEVICE

BACKGROUND OF THE INVENTION

1. Field of the Invention

The present invention relates to a gas lighter ignitable upon depression of a pressing means. More particularly, the present invention relates to a gas lighter with a safety device which ordinarily remains unignitable, that is, in an ignition locked state by the engagement of a resilient leaf on a lighter main body or the pressing means with the lighter main body or the pressing means but becomes ignitable by releasing the ignition lock, that is, rendering the resilient leaf deformed when the lighter is in use.

2. Description of the Prior Art

A gas lighter is a convenient tool which can be easily ignited by the depression of a pressing means such as an actuation lever or the like, but which may be considered not suitable for those who, like children, are unfamiliar with the proper use of the lighter in view of safety, because it is possible for them to ignite the lighter inadvertently. Also, the lighter may be ignited by unintentional depression of the pressing means upon coming into accidental contact with another object.

For these reasons, there is a demand for a gas lighter having an improved safety which prevents the inadvertent ignition of a lighter by those who are unfamiliar with the proper use of that lighter, and prevents the occurrence of unintentional ignition. In response to this demand, child resistant gas lighters with various types of safety device have been heretofore put forward. Most of the safety devices built into these child resistant gas lighters have a lock mechanism which prevents depression of the actuation lever and allows the depression of the actuation lever when it is released. However any of the conventional child resistant gas lighters will have drawbacks in their usage, and hence it is desirable for the gas lighter to be improved for practical use.

For instance, as disclosed in U.S. Pat. Nos. 4,859,172, 4,786,248, and 4,784,602 and Japanese Utility Model Publication No. 3(1991)-35971, any one of the disclosed safety devices is provided with a lock member for preventing depression of the actuation lever. Since the lock member is manually movable between a lock position and a release position, the lock member tends to stay at the release position without a manual recovery from the release position to the initial position after the use of the lighter, whereby the safety device remains unlocked. Leaving the lock member at the release position permits the depression of the actuation lever, which renders the safety device inoperable. Specifically then, to ensure safety, the existing safety devices always require a manual re-locking operation after the use of the lighter with the lock mechanism unlocked, and hence there were expected further improvements of the lock mechanism in terms of safety.

To solve the drawbacks set forth above, there have been put forward, as a safety device having a lock member to hinder the depression of the actuation lever, safety devices with what is called an auto-return function wherein the lock member automatically returns to the lock position in response to the ignition operation after the lock member has been manually moved to the release position. U.S. Pat. Nos. 5,002,482, and 3,898,031 and Japanese Unexamined Patent Publication No. 3(1991)-25215, for instance, disclose such safety devices as having the auto-return function which allows automatic return of the lock member to the lock position in response to the ignition operation. With these safety devices, however, the lock mechanism is only released by motion of a finger along an L-shaped path. This makes the lock mechanism inferior in operability and in the ease of releasing the lock member because a lighter of this type generally requires operation with a single finger, such as a thumb, leading to different results depending on the users. Therefore, safety devices of this type can be said to be disadvantageous in practical use. Further, the operation of these safety devices is unreliable because of a probability that the lock member will return to the lock position by its own reactive force caused by the resilience of the material constituting the lock member.

Furthermore, there have been proposed safety devices wherein the lock member is released by the motion of a finger not along the L-shaped path but along a simple linear path. However, any of those have drawbacks in practical use. The safety device as disclosed in, for example, Japanese Patent Publication of Translated Version (PCT) No.3(1991)-501647 is provided with an automatic return function wherein the part of a lock member composed of a spring is moved along an arcuate path to a release position and held there, then it automatically returns to a lock position in response to ignition operation. In this type of safety device, the arrangement for guiding the release of the spring-like lock member is not satisfactory, and accordingly the lock member cannot be steadily released. This adversely affects the ease of releasing the lock mechanism in the gas lighter, which is generally operated with a single finger, and, as with the preceding example, resulting operations will be different depending on the users. Since the lock member itself is made of a spring, the lock member may become deformed and cause failure of the lock mechanism after repeated use of the lighter.

In the safety device disclosed in U.S. Pat. No. 4,832,596, the lock member is moved to a release position along a linear path, but automatically returns to the initial position unless it is held at a lock position with a finger other than the one used for actuating the ignition mechanism. Thus, the lock member cannot steadily be released. This adversely affects the ease of releasing the lock mechanism in a gas lighter, which is generally operated with a single finger, e.g. the thumb, and, as with the preceding examples, leads to different operational results depending on the users.

To overcome such drawbacks, an auto-return safety device has been put forward in which the lock member is moved along a linear path to a release position, thereby facilitating the release of the lock mechanism, and at the same time, the lock mechanism can be held in the release position with the finger used for actuating the ignition mechanism, thus not requiring the use of another finger. However, the safety device also has drawbacks in its practical use. Specifically, in the safety device disclosed in U.S. Pat. No. 4,904,180, the lock member is incorporated in the actuation lever which is actuated to ignite the lighter, and the actuation lever can be operated with the use of the same finger that has been used in releasing the lock member, i.e., the thumb that is generally used in ignition operation, thus facilitating a releasing operation. However, when the actuation lever is actuated with the same finger (usually the thumb) which previously moved to the lock member to the release position, the lock member may inadvertently be released from the thumb and may return to the lock position. Accordingly, also in this safety device, the lock member cannot be steadily released. This adversely affects the ease of releasing the lock mechanism in the gas lighter, which is generally operated with a single finger, e.g. the thumb, and, as with the preceding examples, this leads to different operation results depending on the users.

Thus, any one of the existing child resistant safety devices has drawbacks in practical use, and hence there is still a demand for a gas lighter with a safety device which is improved in both safety and operability.

To meet this demand, a gas lighter with the following means has already been put forward. Specifically, as disclosed in U.S. Pat. No. 5,240,408, a safety device is put forward in which a resilient leaf is formed on upper part of a lighter main body, and the end of this resilient leaf engages with a part of a pressing means to prevent the depression of the pressing means, thereby effecting ignition lock. This safety device is also provided with a slide member that is vertically movable along the resilient leaf. The lighter is released from its locked state by elevating the slide member and rendering the resilient leaf deformed, so that the slide member is disengaged from the pressing means. This makes the depression of the pressing member possible, that is, ignition is possible. Together with the pressing means, the slide member is lowered to the lock position, and automatically returns to the ignition lock position when the pressing means is elevated after ignition.

SUMMARY OF THE INVENTION

In view of the foregoing descriptions, the principal object of the present invention is to provide a gas lighter with a safety device that enables the ignition of the lighter upon depression of a pressing means and automatic recovery of a lock lever to a lock position together with the action of the pressing means.

Another object of the present invention is to provide a gas lighter with a safety device that can prevent a lock lever from being left at a release position and ensure the lock of a pressing means when the lighter is not in use.

To achieve this object, according to one aspect of the present invention, there is provided a gas lighter with a safety device comprising:

a lighter main body in which fuel gas is stored;

a fuel supply means for supplying the fuel gas stored in the lighter main body to a nozzle;

an ignition means for igniting the fuel gas discharged from the nozzle;

a pressing means for opening a fuel path to the nozzle in the fuel supply means as a result of pressing operation;

a resilient leaf that is deformable between a locked state where the depression of the pressing means is prevented and a lock-released state where the operation of the pressing means is allowed;

a slide member that is movable from a first position where ignition operation is impracticable when the resilient leaf is in a locked state to a second position where the ignition operation is practicable, and that causes the resilient leaf to be deformed and rendered in a lock released state at a third position which is reached during movement of the slide member from the second position to the first position in response to the ignition operation; and a deformation suppressing means that reduces the amount of deformation of the resilient leaf obtained when the slide member is located at the second position so as to be less than the amount of deformation of the resilient leaf in a lock-released state when the slide member is located at the third position.

According to another aspect of the present invention, there is provided a gas lighter with a safety device comprising:

a lighter main body in which fuel gas is stored;

a fuel supply means that supplies the fuel gas stored in the lighter main body to a nozzle;

an ignition means for igniting fuel gas discharged from the nozzle;

a pressing means for opening a fuel path to the nozzle in the fuel supply means by depressing operation;

a resilient leaf that is resiliently formed in a deformable manner in a part of the lighter main body or the pressing means, and that comes into contact with a part of the pressing means or the lighter main body when in a non-deformed state and is also rendered in a locked state in which the resilient leaf prevents the depression of the pressing means, whereas the resilient leaf allows the operation of the pressing means when the resilient leaf is deformed and rendered in a lock released state;

a slide member which is movable between a first position where ignition operation is impracticable when the resilient leaf is in a locked state and a second position where the ignition operation is practicable, and which causes the resilient leaf to be deformed and rendered in a lock released state at a third position which is reached during movement of the slide member from the second position to the first position in response to the depression of the pressing means; and a deformation suppressing means that reduces the amount of deformation of the resilient leaf when the slide member is located at the second position so as to be less than the amount of deformation of the resilient leaf when the slide member is located at the third position and is in a lock-released state, whereby the slide member causes the resilient leaf to be deformed and rendered in a lock released state in response to the movement of the pressing means before the resilient leaf comes into contact with the pressing means.

It is preferable for the deformation suppressing means to be shaped into a recessed insertion section that makes the slide member located at the second position move in the opposite direction to the deformation of the resilient leaf. It is possible to create this insertion section on the lighter main body or the pressing means, or the deformation suppressing means may be created in a contact position between the slide member and the resilient leaf.

It is desirable that the slide member should move and forcibly deform the resilient leaf together with the movement of the pressing means by means of a cam surface. This slide member may be constituted in such a way that it engages with a part of the resilient leaf or the lighter main body during the course of its travel from the first position to the second position as a result of the user's operation, and is disengaged by displacement occurring when the slide member is pressed inwards. Moreover, a recess for mitigating the amount of the deformation of the resilient leaf may be formed at an ignition location where the pressing means is pressed down.

According to a third aspect of the present invention, there is provided a gas lighter with a safety device comprising;

a lighter main body in which fuel gas is stored;

a fuel supply means for supplying the fuel gas stored in the lighter main body;

a pressing means for opening a fuel path to the nozzle in the fuel supply means;

a resilient leaf deformable between a locked state in which the depression of the pressing means is prevented and a lock released state in which the operation of the pressing means is allowed;

a slide member that causes the resilient leaf to be deformed from its locked state to a lock released state; and a deformation suppressing means that reduces the amount of deformation of the resilient leaf caused by the slide member when the slide member is located at a location where ignition operation is practicable so as to be less than the amount of deformation of the resilient leaf when the slide member is in the lock released state.

According to the gas lighter with the safety device, when the slide member locates at the first position where the ignition operation is not practicable, the end of the resilient leaf is in a locked state in which it can interfere with the pressing means or the lighter main body. The resilient leaf prevents depression of the pressing means, thereby carrying out ignition lock. When the slide member is moved to the second position where the ignition operation is practicable, the resilient leaf remains in a non-deformed state or in a deformation suppressed state in which the resilient leaf is less deformed in the same manner as in the locked state. Even when the lighter is left in this state, an ignition lock failure due to plastic deformation is definitely eliminated.

When the pressing means is depressed to carry out ignition, the slide member starts to move from the second position to the first position in response to this ignition operation. On its way to the first position, the slide member deforms the resilient member in a lock releasing direction at the third position, whereby the pressing means can be pressed to an ignition position. Then, the fuel gas discharged by a pressing action of the pressing means is fired by the ignition means. In conjunction with the pressing action of this pressing means, the slide member moves to the first position and makes the pressing means free, and then returns to its initial position. This releases the resilient leaf from the deformed state that was caused by the slide member, and the resilient leaf enters an ignition lock state, which prevents the pressing means thus returned from being pressed. Thus, inadvertent ignition of the lighter is prevented, and hence it is possible to realize a gas lighter with a considerably high degree of safety.

A structure for preventing the movement of the slide member to the second position by locking it between the first position and the second position is provided on the resilient leaf or the lighter main body, and the lock of the slide member is released by displacement by inwardly pressing the slide member. Such a structure requires two-staged operations of the slide member, and this makes it impossible for those who are unfamiliar with the proper use of the gas lighter to perform ignition operation. Thus, the prevention of the inadvertent ignition of a lighter is ensured to a much greater extent, and a feeling of the movement of the slide member to the second position where ignition operation is practicable is definitely obtained.

At an ignition position to which the pressing means is to be pressed, a recess for mitigating the amount of deformation of the resilient leaf is created, which reduces the required amount of deformation of the resilient leaf to a much greater extent.

Thus, the slide member is movable from the first position, where ignition operation is impracticable, to the second position, where the ignition operation is practicable, relative to the resilient leaf that hinders the depression of the pressing member when in a non-deformed state. In response to ignition operation, the resilient leaf is deformed and rendered in a lock-released state at the third position midway between the first position and the second position. The deformation suppressing means is provided for reducing the amount of deformation of the resilient leaf caused by the slide member located at the second position so as to be less than that obtained when the slide member is located at the second position. With such a deformation suppression means, the resilient leaf remains less deformed when the slide member is moved to the second position in order to perform the ignition operation. If the lighter is left for a long period of time in this state, the resilient leaf will not be plastically deformed, and hence the pressing of the pressing means will be ensured. It is possible to increase the reliability of the safety device while its ignition lock function is maintained.

BRIEF DESCRIPTION OF THE DRAWING

FIGS. 4A and 4B are exploded perspective views showing chief elements of the gas lighter with the safety device as shown in FIG. 1, wherein FIG. 4A illustrates features of a resilient leaf and FIG. 4B illustrates features of a slide member;

FIGS. 5A and 5B are perspective views showing operating actions of chief elements of the gas lighter with the safety device as shown in FIG. 1, wherein FIG. 5A illustrates an action of the slide member when it is inwardly pressed and FIG. 5B illustrates an action of the slide member when it is fitted into an intermediate case;

FIGS. 6A and 6B are perspective views showing operating actions of chief elements of the gas lighter with the safety device as shown in FIG. 1, wherein FIG. 6A illustrates the movement of the slide member when an operation cap is pressed and FIG. 6B illustrates the deformation of the resilient leaf when the slide member is lowered to a first position;

FIGS. 7A and 7B are longitudinal cross-sectional views showing operating actions of chief elements of the gas lighter with the safety device as shown in FIG. 1, wherein FIG. 7A illustrates an action of the slide member when it is inwardly pressed and FIG. 7B illustrates an action of the slide member when it is thrust upwards to a second position;

FIGS. 8A and 8B are longitudinal cross-sectional views showing operating actions of chief elements of the gas lighter with the safety device as shown in FIG. 1, wherein FIG. 8A illustrates the movement of the slide member when the operation cap is pressed and FIG. 8B illustrates the deformation of the resilient leaf when the slide member is lowered to the first position;

FIGS. 13A and 13B are perspective views showing chief elements of a gas lighter with a safety device according to a sixth embodiment of the present invention, wherein FIG. 13A corresponds to FIG. 1 and illustrates a slide member located at a first position and FIG. 13B corresponds to FIG. 5B and illustrates the slide member located at a second position;

FIGS. 16A and 16B are longitudinal cross-sectional views showing the gas lighter with the safety device shown in FIG. 14 when it is in an operating state, wherein FIG. 16A illustrates a resilient leaf that remains in a non-deformed state when a slide member is inwardly moved and FIG. 16B illustrates the resilient leaf which is deformed when the slide member locates at a third position;

FIGS. 19A–19C are exploded perspective views showing the chief elements of the gas lighter with the safety device shown in FIG. 17, wherein FIG. 19A illustrates an operation cap with a resilient leaf, FIG. 19B illustrates an intermediate case with an engagement projection, and FIG. 19C illustrates a slide member which slidably moves along the engagement projection;

FIGS. 20A–20C are longitudinal cross-sectional views showing actions of the chief elements of the gas lighter with the safety device shown in FIG. 17, wherein FIG. 20A illustrates a resilient leaf which remains non-deformed when a slide member moves to a second position, FIG. 20B illustrates the movement of the slide member when an operation cap is pressed, and FIG. 20C illustrates the slide member locating at a first position after ignition operation.

PREFERRED EMBODIMENT OF THE INVENTION

Figure 1:
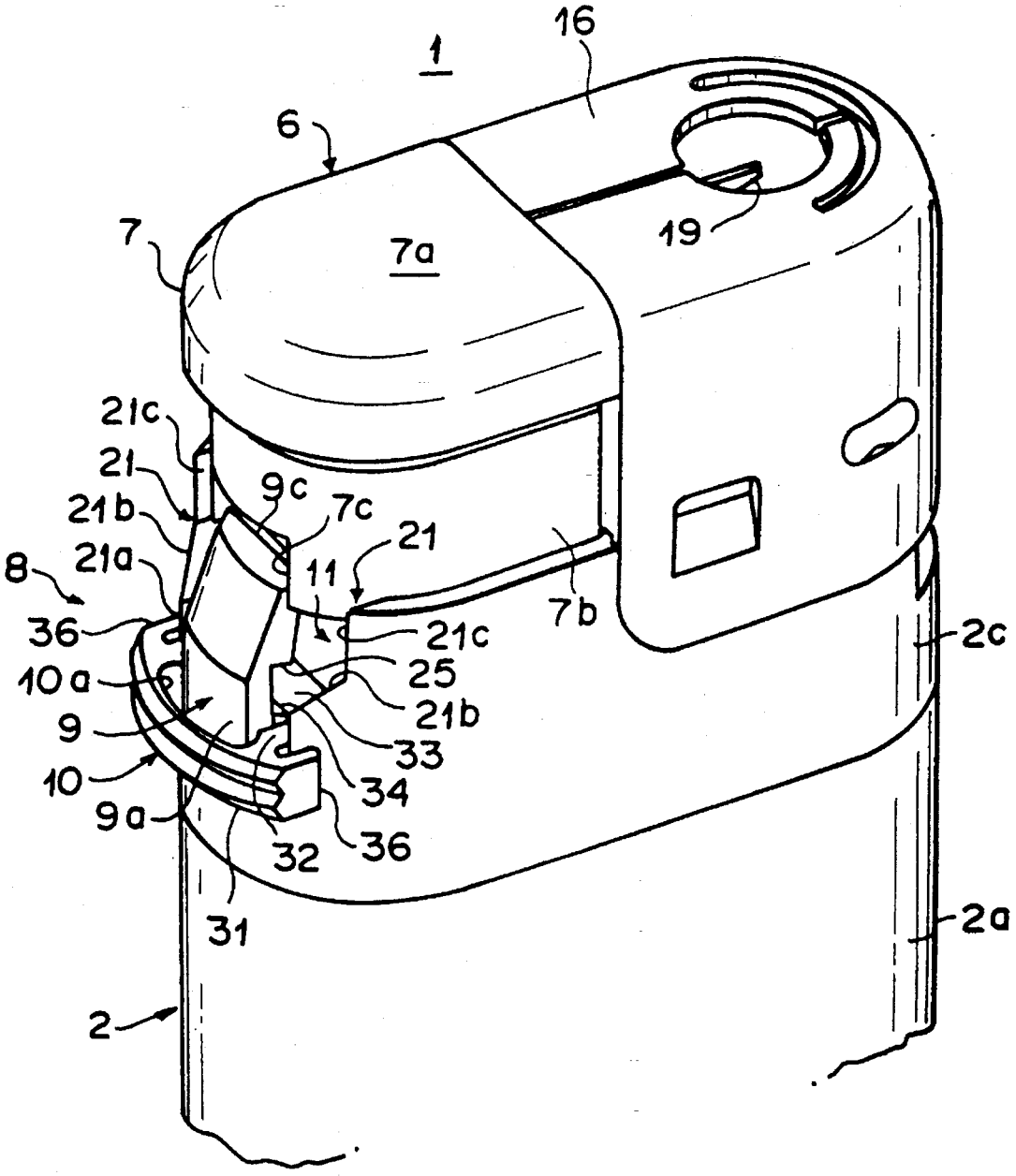
FIG. 1 is a perspective view showing chief elements of a gas lighter with a safety device according to a first embodiment of the present invention.

With reference to the accompanying drawings, preferred embodiments of the present invention will be described hereinbelow in detail.

First Embodiment:

FIGS. 1 through 8 show an electric discharge ignition type gas lighter with a safety device 1 according to a first embodiment of the present invention.

The gas lighter with the safety device 1 is made up of: a lighter main body 2 in which fuel gas is stored; a fuel supply means 4 having a nozzle 3 which discharges the fuel gas; an operation cap 7 composed of an ignition means 5 having a piezoelectric unit 18 and a pressing means 6 which actuates the fuel supply means 4 and performs ignition; and a safety mechanism 8 disposed on top of the lighter main body 2 for locking and unlocking the pressing means 6.

The safety mechanism 8 is provided with: a resilient leaf 9 engageable with the operation cap 7; a slide member 10 fitted around the resilient leaf 9 that is slidable between a first position at its lowermost position and a second position at its uppermost position and deforms the resilient leaf 9 at its third position between the first position and the second position; and a deformation suppressing means 11 that reduces the deformation of the resilient leaf 9 caused by the slide member 10 locating at the second position.

The lighter main body 2 has a rectangular-parallelepiped tank main body 2*a* made of synthetic resin. An upper cover 2*b* is hermetically fixed on an upper surface of the tank main body 2*a*, and a tank section for storing fuel gas such as butane gas or the like is constituted inside the tank main body 2*a*. An intermediate case 2*c* is fitted to the top of the upper cover 2*b* separately from the tank section.

The fuel supply means 4 made of a known valve mechanism for regulating the amount of emission of stored fuel gas is disposed on the upper cover 2*b* of the lighter main body 2, and the nozzle 3 provided on the fuel supply means 4 upwardly projects. This nozzle 3 meshes with a groove formed on one end of an L-shaped actuation lever 15. The actuation lever 15 is pivotally supported above an upper part of the lighter main body 2 by a fulcrum of an angled section, and is disposed while its other end obliquely extends in a downward direction. Fuel gas is discharged when the nozzle 3 is moved upwardly together with the pivotal movement of this actuation lever 15. A windproof cap 16 is attached so as to surround an area above the nozzle 3. A flame extension regulator ring 17 is also provided for regulating the amount of emission of gas from the nozzle 3.

The operation cap 7 corresponding to the pressing means 6 is disposed on the opposite side of the lighter main body 2 to the nozzle 3 on the lighter main body 2 (an intermediate case 2*c*) side by side with the windproof cap 16. An upper surface of this operation cap 7 serves as a pressing operation surface 7*a*, and a sidewall 7*b* that downwardly extends is provided along the outer periphery of a rear lower part of the operation cap 7. The cylindrical bottom of the operation cap 7 is fitted on the upper end of a piezoelectric unit 18 of the ignition means 5, and can press the piezoelectric unit 18. An engagement recess 7*c* is formed in a lower back of the sidewall 7*b* of the operation cap 7 that is opposite to the windproof cap 16. The inside of the engagement recess 7*c* is made deeper than its outside, and has a structure that makes it difficult for an end 9*c* of the resilient leaf 9, which will be described later, to be disengaged from the recess 7*c*.

The ignition means 5 has a discharge electrode 19 that is connected to the piezoelectric unit 18 and disposed on the inner side of the operation cap 7. Electrical discharge for ignition purposes is carried out by applying a high voltage resulting from the actuation of the piezoelectric unit 18 between the discharge electrode 19 and the nozzle 3.

In conjunction with the pressing action of the operation cap 7 of the pressing means 6, an upper portion of the piezoelectric unit 18 is lowered. A lever presser 20 which can come into contact with the other end of the actuation lever 15 of the fuel supply means 4 is disposed on the movable portion of the piezoelectric unit 18. This causes the lever presser 20 to pivotally move the actuation lever 15 together with the pressing action of the operation cap 7, so that fuel gas is discharged from the nozzle 3. Further pressing of the operation cap 7 actuates the ignition means 5, whereby discharge ignition is effected.

Figure 5A:
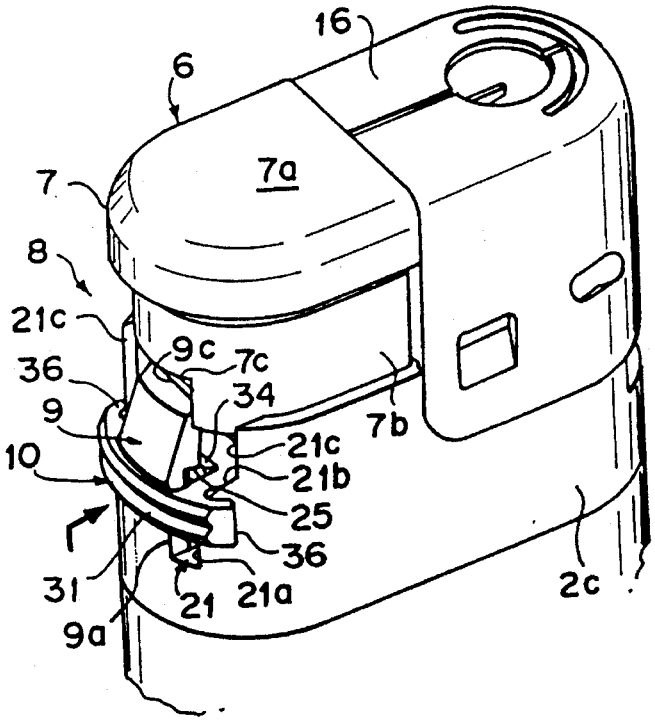

The structure of the safety mechanism 8 will now be described. As illustrated in FIG. 5A, the intermediate case 2*c* of the lighter body 2 is continuous with the sidewall of the tank main body 2*a* below the intermediate case 2c, and constitutes a sidewall that extends upwardly. The resilient leaf 9 that vertically extends is formed, in an integrated fashion, in a curved portion of the intermediate case 2*c* which is opposite to the windproof cap 16. This resilient leaf 9 is defined by making two slide slits 21 in the curved portion of the intermediate case 2*c*. The lowermost end of the resilient leaf 9 is connected to the intermediate case 2*c*, whereas the uppermost end thereof is rendered free and deformable. The resilient leaf 9 is shaped from synthetic resin together with the intermediate case 2*c* in an integrated fashion, and is plastically deformable because of the characteristics of the material.

Figure 4B:
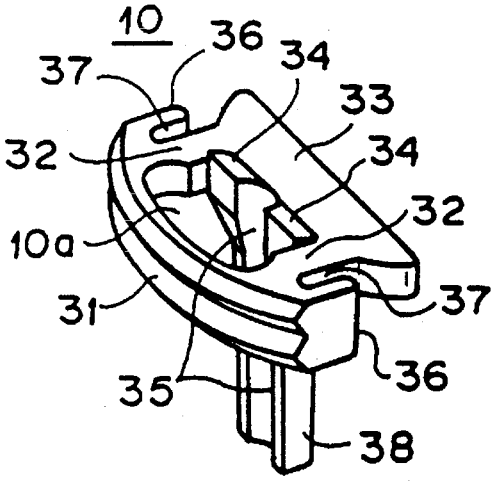
Figure 4A:
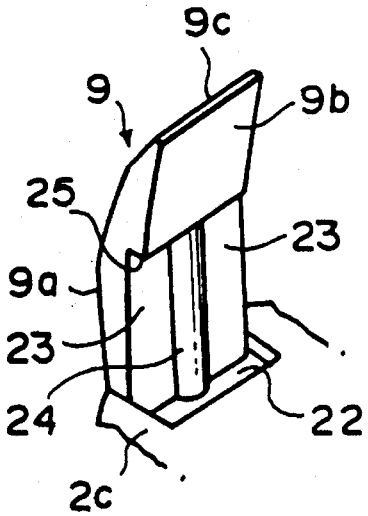

As shown in FIG. 4A, the resilient leaf 9 has a base 9*a* that is connected to the intermediate case 2*c* and stands upright. An upper portion of the resilient leaf 9 is provided with a contact surface 9*b*, the inner surface of which is inclined more toward the inside of the lighter at its upper portion. Similarly, the outer surface of the resilient leaf 9 is also inclined more toward the inside of the lighter at its upper portion. The end 9*c* of the resilient leaf 9 is thinly formed. When the resilient leaf 9 is non-deformed and rendered locked, the end 9*c* can engage with the engagement recess 7*c* of the operation cap 7. The engagement between the end 9*c* and the engagement recess 7*c* prevents the downward pressing of the operation cap 7.

A rib 24 is formed at the center of the inner side of the base 9*a* of the resilient leaf 9, and extends from the lowermost end of the contact surface 9*b* to the lowermost end of the resilient leaf 9. Guide sections 23 are also created on both sides of this rib 24. A wedge-like stopper 25 which engages with the upper end of an engagement section 34 of the slide member 10 is formed on the upper end of the guide sections 23. An insertion indentation 22 is formed in an area where the intermediate case 2*c* is connected to the resilient leaf 9, that is, an area on the inner side of the lower end of the base 9*a* (see FIG. 4A).

Slide grooves 21 on both sides of the resilient leaf 9 are made in a curved portion of the intermediate case 2*c*, and a lower portion 21*a* of each slide groove 21 has a narrower width corresponding to the width of a link section 32 of the slide member 10 which will be described later. On the other hand, an upper portion 21*c* of the slide groove 21 has a wider width that allows the insertion of a pawl 36 of the slide member 10 which will be described later. An intermediate portion between the upper and lower portions is obliquely cut and provided with a bevel that has a wider width in the upward direction. This bevel acts as an inclined portion 21*b* (a cam surface) for pressing the slide member 10.

As shown in FIG. 4B, the slide member 10 that is slidably fitted around the resilient leaf 9 is provided with: an actuation lug 31 which is outwardly warped; the link section 32 extending from both ends of the actuation lug 31 to the inside of the lighter; and a plate-like receiving section 33 positioned closer to the inside of the lighter. An opening 10*a* through which the resilient leaf 9 passes is formed in the slide member 10 between the actuation lug 31 and the receiving section 33. A longitudinal groove 35 on which the rib 24 of the resilient leaf 9 slides is formed in the inner surface of the opening 10*a* on the side of the receiving section 33, and engagement sections 34 over which the guide section 23 of the resilient leaf 9 slide are formed on both sides of the groove 35.

Both ends of the receiving section 33 are shaped into a curved surface so that they may match the configuration of the inner surface of the curved portion of the intermediate case 2*c*. The pawls 36 whose ends come into contact with the exterior surface of the intermediate case 2*c* outside the slide grooves 21 are connected to both ends of the actuation lug 31 of the slide member 10. These pawls 36 are provided with resiliency by means of slits 37, and hence they are deformed so as to extend outwardly when the actuation lug 31 is pressed towards the inside of the lighter, thereby allowing a shift of the receiving section 33 towards the inside of the lighter.

A leg 38 is connected to a lower surface of the receiving section 33, and the longitudinal groove 35 is continuously made in this leg 38. Upper ends of the engagement sections 34 are formed so as to obliquely project upwards. Similarly, the stopper 25 on the upper ends of the guide sections 23 of the resilient leaf 9 is formed to have an acutely angular inner corner, whereby engagement of the engagement sections 34 with the stopper 25 is ensured.

When such a slide member 10 is fitted around the resilient leaf 9, the link sections 32 on both sides pass through the slide grooves 21 and vertically move, and also the leg 38 is inserted into the insertion indentation 22 of the intermediate case 2*c*. An upper surface of the receiving section 33 can come into contact with the lower end of the operation cap 7. The size of the opening 10*a* of the slide member 10 is designed in such a way that a semi-circular gap (see FIG. 1) is made outside the resilient leaf 9 while the engagement sections 34 are in slidable contact with the guide sections 23. When the slide member 10 is situated at the inclined portions 21*b* and the insertion portion 21*c* of the slide groove 21 during its upward motion, the pawls 36 on both ends of the actuation lug 31 can enter the inside of the slide groove 21. While the pawls 36 are fitted into the slide groove 21, it is possible for the bottoms of the pawls 36 to come into slidable contact with inclined surfaces of the inclined portions 21*b* of the slide groove 21.

In the above structure, the deformation suppressing means 11 is provided in order to prevent the deformation of the resilient leaf 9 caused by the slide member 10 locating at the second position (the upper most end), and is made up of the insertion portion 21*c* of the slide groove 21 that causes the slide member 10 to displace in a direction opposite to the direction of the deformation of the resilient leaf 9, that is, towards the inside of the lighter. When the slide member 10 is situated at the third position between the second position and the first position (the lowermost end), the pawls 36 thereof come into slidable contact with the inclined portions 21*b* (cam surfaces), so that the slide member 10 is displaced outwardly. At this time, the engagement sections 34 of the slide member 10 press the contact surface 9*b*, whereby the resilient leaf 9 is deformed and rendered in a lock released state. On the other hand, when the slide member 10 is located at the first position, the engagement sections 34 come into slidable contact with the guide sections 23, so that the resilient leaf 9 is prevented from being pressed and deformed.

Figure 2:
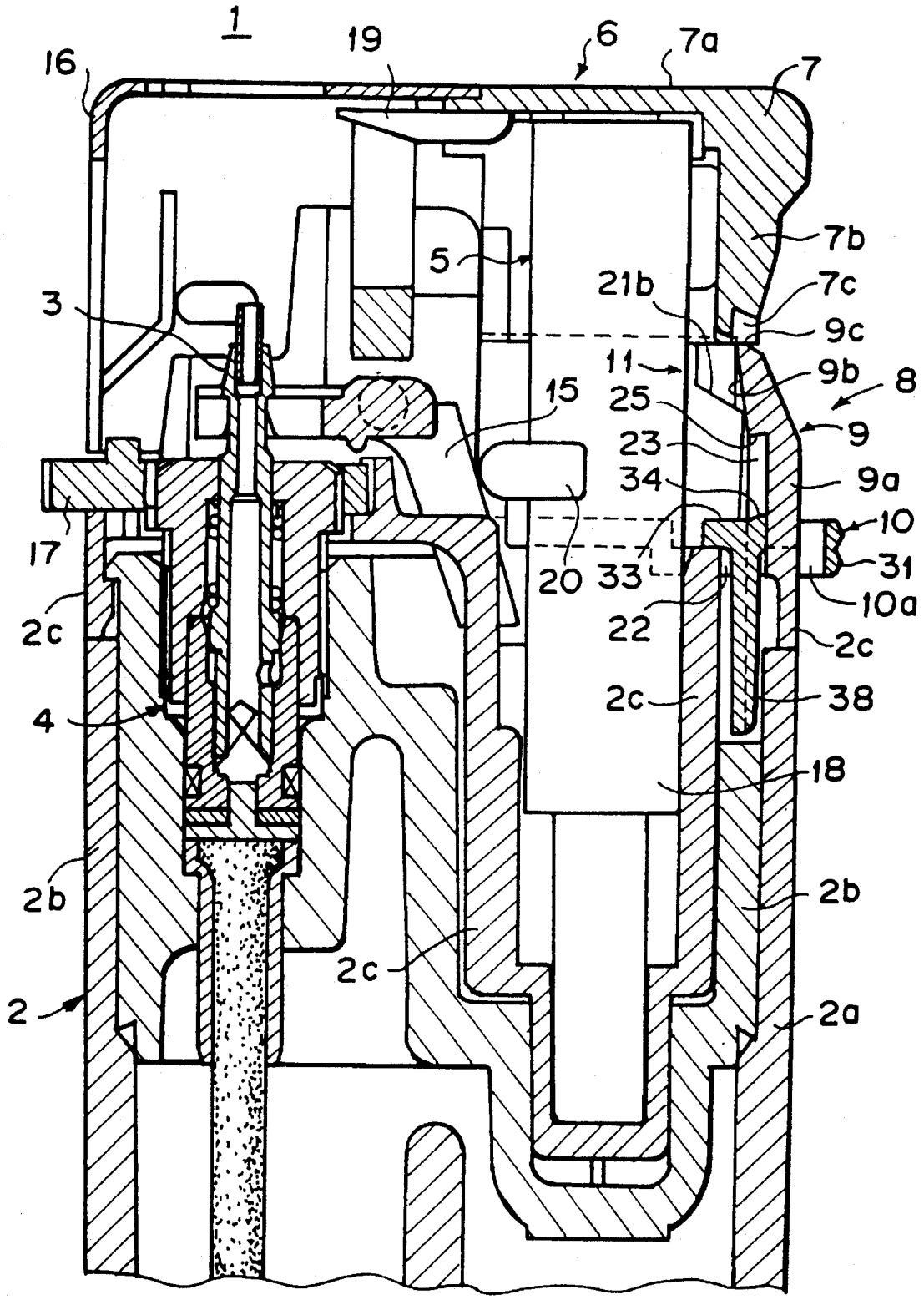
FIG. 2 is a longitudinal cross-sectional view of the gas lighter with the safety device as shown in FIG. 1.
Figure 3:
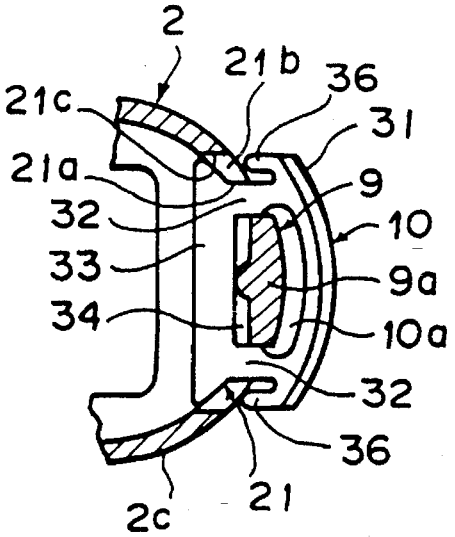
FIG. 3 is a cross-sectional plan view showing chief elements of the gas lighter with the safety device as shown in FIG. 1.

The operation of the gas lighter with the safety device according to this embodiment will now be explained. As shown in FIGS. 1 and 2, when the slide member 10 is situated at the position where an ignition action is impracticable, that is, at the lower portion 21*a* of the slide groove 21 (the first position), the resilient leaf 9 is in a non-deformed state (a locked state). When the operation cap 7 is pressed, the engagement recess 7*c* meshes with the end 9*c* of the resilient leaf 9. This interferes with the operation cap 7 and prevents it being pressed further. Thus, the resilient leaf 9 is in an ignition-locked state in which the emission of fuel gas and an igniting operation are impossible to perform. Moreover, in this locked state, the slide member 10 is provided with sufficient play for the engagement sections 34 to freely slide over the guide sections 23 of the resilient leaf 9. This ensures that the slide member 10 is in a locking range. In this state, the engagement sections 34 mesh with the stopper 25 even when the slide member 10 is upwardly moved, and hence the resilient leaf 9 remains non-deformed.

Figure 7A:
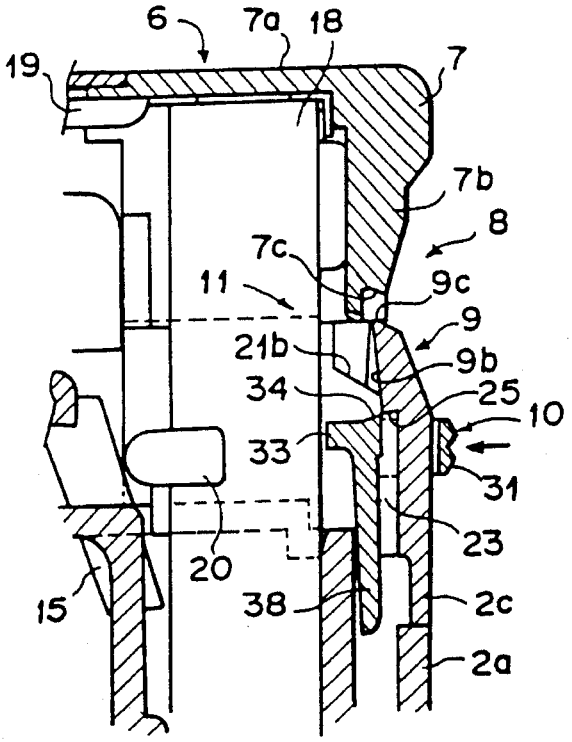

When the gas lighter is used, the actuation lug 31 of the slide member 10 is upwardly thrust to the second position while being pressed inwardly. Specifically, when the slide member 10 is inwardly pressed, the ends of the pawls 36 on both sides are deformed so as to come into contact with, and extend along, the exterior surface of the intermediate case 2*c* as illustrated in FIGS. 5A and 7A. As a result of this, the slide member 10 is moved inwardly, and the upper ends of the engagement sections 34 are inwardly disengaged from the stopper 25 formed on the upper ends of the guide sections 23 of the resilient leaf 9. The slide member 10 is disengaged from the resilient leaf 9, and it becomes possible to move it towards the insertion portion 21*c* located on the upper end from the inclined portion 21*b* of the slide groove 21.

When the slide member 10 arrives at the insertion portion 21*c* of the slide groove 21 (the second position), the slide member 10 does not engage with the intermediate case 2*c* but enters it, because the insertion portion 21*c* of the slide groove 21 is formed wider than the pawls 36.

Figure 5B:
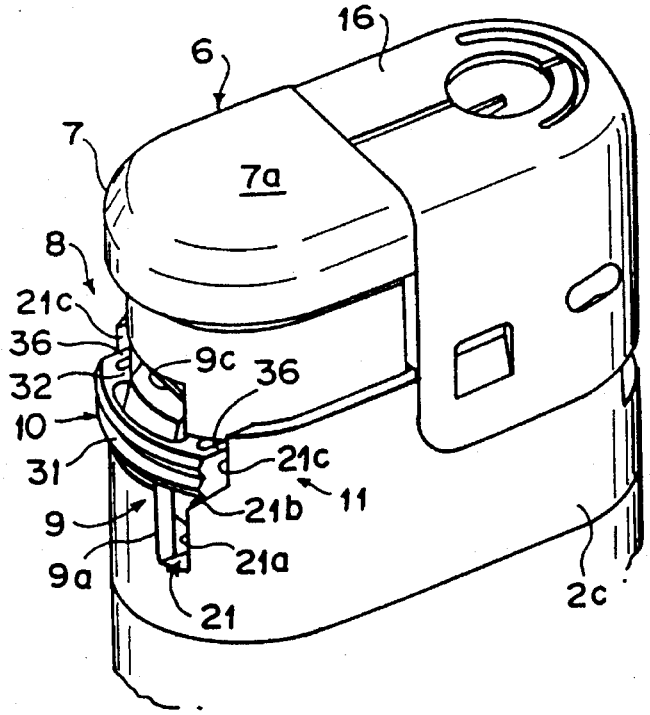
Figure 7B:
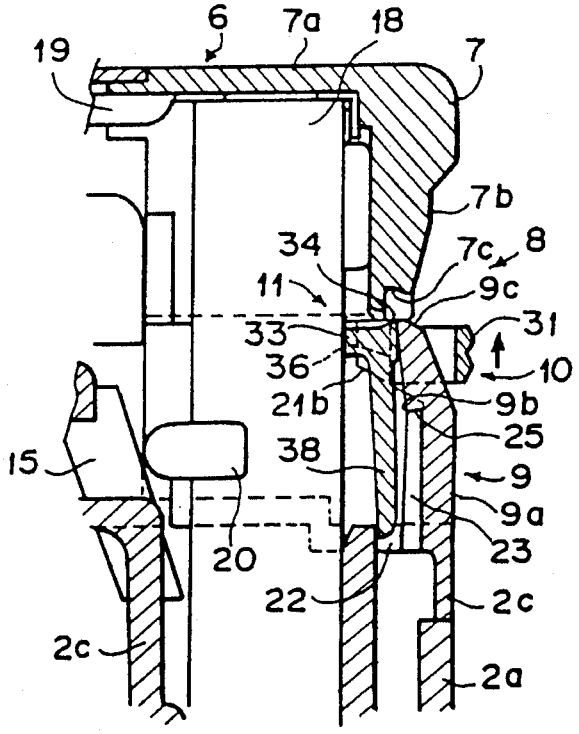

When the slide member 10 is situated at the upper end, that is, the second position, the bottom ends of the pawls 36 are in contact with the inclined surfaces of the inclined portions 21*b*, respectively, as illustrated in FIGS. 5B and 7B. In addition, the upper surface of the receiving section 33 is in close proximity to the lower end of the operation cap 37. In this state in which ignition operation is practicable, the resilient leaf 9 is not deformed, and hence it is possible to eliminate possibility that the resilient leaf 9 will be plastically deformed into such a shape that the end of the resilient leaf 9 cannot mesh with the engagement recess 7*c* of the operation cap 7 even if the gas lighter is left for a long period of time.

Figure 6A:
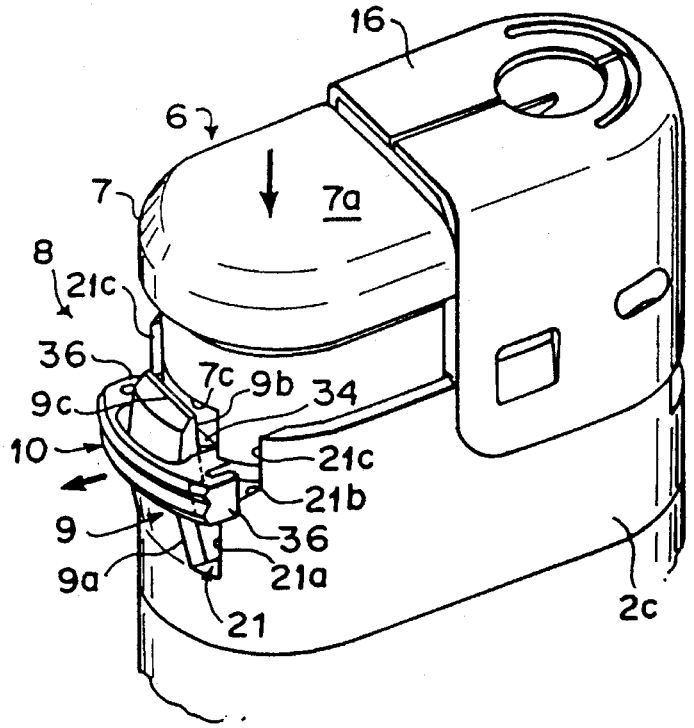
Figure 8A:
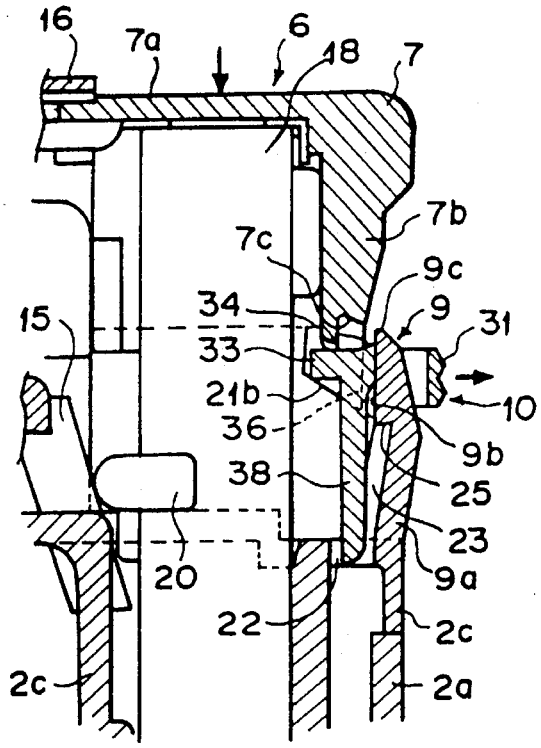

When the operation cap 7 is depressed to the first position while the slide member 10 is located at the second position, the bottom of the operation cap 7 is pressed against the receiving section 33 at the third position in an initial stage before the engagement recess 7*c* of the operation cap 7 meshes with the end 9*c* of the resilient leaf 9, so that the slide member 10 is depressed as illustrated in FIGS. 6A and 8A. Together with this, the slide member 10 experiences a force that causes the slide member 10 to project and move towards the outside when a lower surface of the receiving section 33 comes into contact with the inclined surface (a cam surface) of the inclined portion 21*b* of the slide groove 21. Because of this pressing force, the engagement sections 34 of the slide member 10 act so as to press the contact surface 9*b* of the resilient leaf 9 towards the outside.

The resilient leaf 9 is outwardly deformed and rendered into a lock released state by the slide member 10, and hence it is displaced from the location below the engagement recess 7*c* of the operation cap 7, thereby making engagement interference impossible. Thus, depression of the operation cap 7 becomes possible.

Figure 6B:
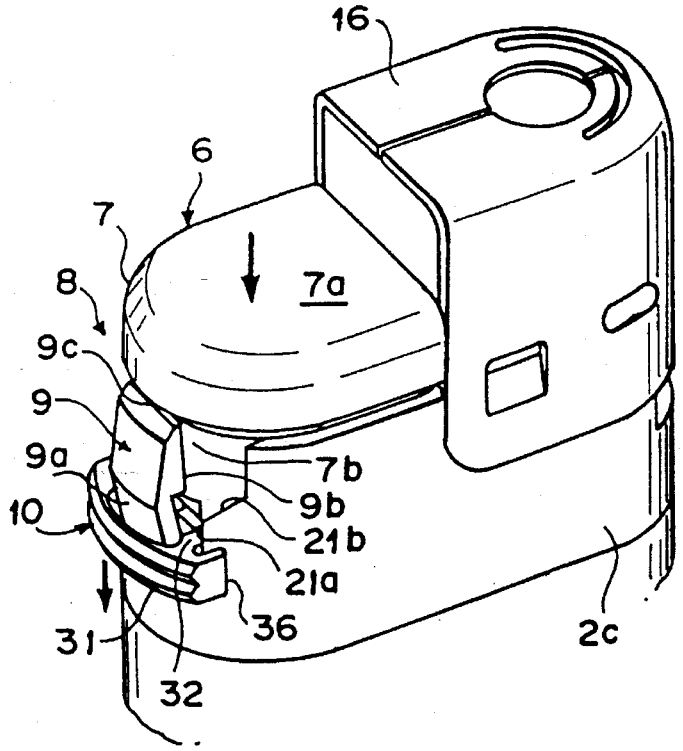
Figure 8B:
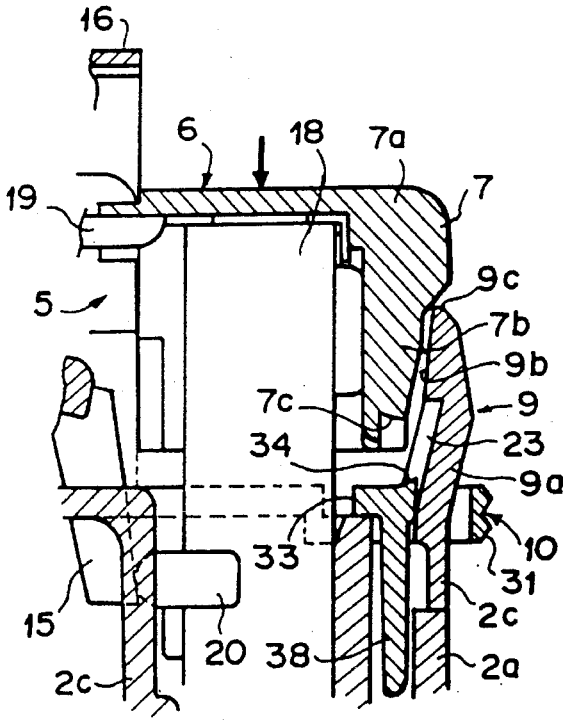

When the operation cap 7 is depressed further, the lever presser 20 causes the actuation lever 15 to pivotally move, which in turn causes the nozzle 3 of the fuel supply means 4 to be activated, so that fuel gas is discharged. In addition to the pivotal movement of the actuation lever, the piezoelectric unit 18 is also compressed, and ignition operation is carried out. Moreover, the slide member 10 moves down further. While projecting outwards because of the presence of the inclined portion 21*b*, the slide member 10 causes the resilient leaf 9 to be deformed. However, as shown in FIGS. 6B and 8B, further downward movement of the slide member 10 causes the bottom of the pawls 36 to be disengaged from the inclined portion 21*b*, and the pawls 36 are lowered to the first position along the exterior surface of the intermediate case 2*c*. During the course of downward travel of the slide member 10, the engagement sections 34 of the slide member 10 are disengaged from the contact face 9*b*, but mesh with the guide sections 23 below the contact face 9*b*. This releases the resilient leaf 9 from the pressed and deformed state caused by the slide member 10. However, the end 9*c* of the resilient leaf 9 comes into contact with the bottom of the operation cap 7 thus lowered, and hence the resilient leaf 9 is still left in a deformed state.

When a finger is released from the operation cap 7 in order to extinguish the flame, the operation cap 7 returns to its initial elevated position owing to a recoiling force of such as a spring housed in the piezoelectric unit 18. The resilient leaf 9 returns to its original position much closer to the inside of the gas lighter because of its resiliency. Thus, as shown in FIGS. 1 and 2, the end 9*c* of the resilient leaf 9 is again rendered engageable with the engagement recess 7*c* formed on the lower end of the operation cap 7, and the resilient leaf 9 automatically returns to its lock state to prevent the depression of the operation cap 7.

Figure 9:
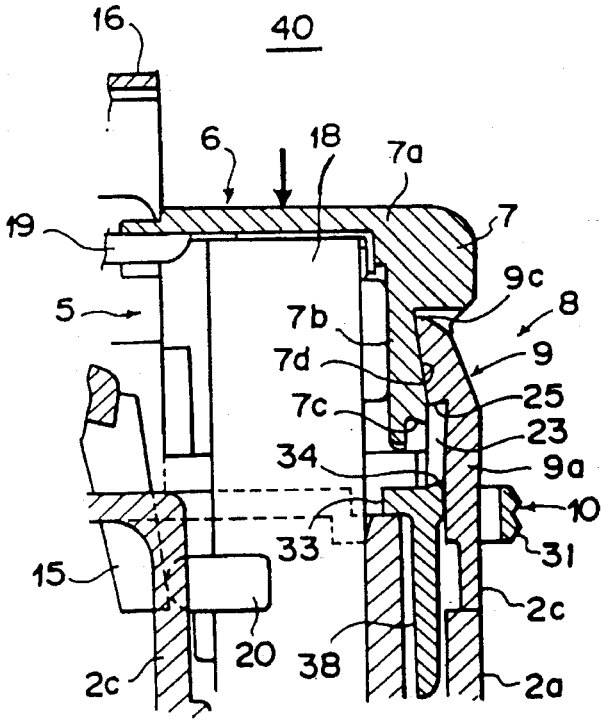
FIG. 9 is a longitudinal cross-sectional view showing chief elements of a gas lighter with a safety device according to a second embodiment of the present invention.

Second Embodiment:

FIG. 9 shows a gas lighter 40 with a safety device according to a second embodiment, in which an operation cap is a modified example of that of the first embodiment.

The operation cap 7 of the pressing means 6 of this embodiment is provided with a slot-like indentation 7*d* that has a width slightly wider than that of the resilient leaf 9 and is located above the engagement recess 7*c*. The end of the resilient leaf 9 is inserted into the indentation 7*d*. Other features are provided in the same manner as in the previous embodiment. Same reference numerals are given to designate corresponding features, and hence the explanation thereof will be omitted here for brevity.

According to this embodiment, in the same manner as in the previous embodiment, when the slide member 10 is located at the first position where ignition operation is impracticable, the engagement recess 7*c* of the operation cap 7 is engaged with the end 9*c* of the resilient leaf 9 in its lock state when depression of the operation cap 7 is attempted, whereby ignition lock is effected. The operation cap 7 is pressed down to the first position after the slide member 10 has been elevated to the second position, where the ignition operation is practicable, by the same operation as in the previous embodiment. The slide member 10 that is downwardly moved along with the operation cap 7 causes the resilient leaf 9 to be deformed and rendered in a lock-released state by means of the inclined cam surface of the inclined portion 21*b* of the slide groove 21, formed in the same manner as in the previous embodiment, at the third position midway between the second position and the first position. Thus, ignition operation becomes possible.

Together with the downward movement of the operation cap 7 from the third position, the resilient leaf 9 is released from the deformed state that is caused by the slide member 10. The resilient leaf 9 resumes its original shape because of its resiliency. In the previous embodiment, the resilient leaf 9 comes into contact with the side surface 7*b* of the operation cap 7, and hence the resilient leaf 9 is kept in a deformed state. However, in this embodiment, the amount of deformation of the resilient leaf 9 is reduced by inserting the resilient leaf 9 into the indentation 7*d*. Thus, the required amount of deformation of the resilient leaf 9 is reduced to suppress plastic deformation thereof to a much greater extent.

Figure 10:
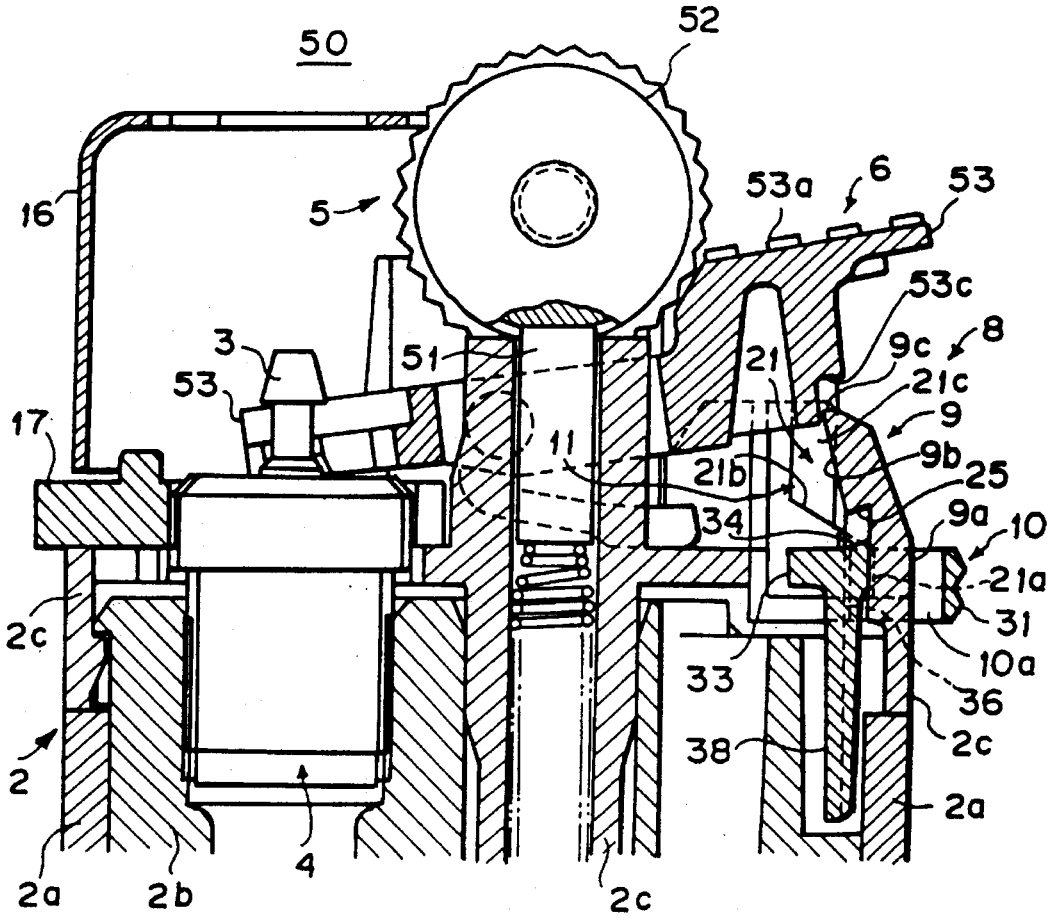
FIG. 10 is a longitudinal cross-sectional view showing chief elements of a gas lighter with a safety device according to a third embodiment of the present invention.

Third Embodiment:

FIGS. 10A and 10B shows a gas lighter with a safety device according to a third embodiment, and the gas lighter utilizes another ignition system which differs from the gas lighter of the first embodiment. The same reference numerals are provided to designate the corresponding features of the first embodiment, and the explanation thereof will be omitted here for brevity.

The ignition system of the gas lighter of this embodiment is a so-called flint system. The gas lighter of this embodiment is provided with an ignition means 5 (a firing means) which is composed of flint 51 and a file 52. An actuation lever 53 for regulating the emission of fuel gas is pivotally mounted, as the pressing means 6, on an upper part of the lighter body 2 via a fulcrum. The end of the actuation lever 53 is engaged with the nozzle 3 of the fuel supply means 4 in the same manner as in the previous embodiment shown in FIG. 2.

In the safety mechanism 8 of this embodiment, an engagement recess 53*c* is formed in the lower end of a pushing down section 53*a* on the file side of the actuation lever 53, and the end 9*c* of the resilient leaf 9 formed in the same manner as in the previous embodiment meshes with the engagement recess 53*c*. The structure of this resilient leaf 9, the slide member 10 fitted around the resilient leaf 9 and the slide grooves 21 into which the slide member 10 is inserted are of the same construction as those of the first embodiment. The deformation suppressing means 11 is constituted for reducing the amount of deformation of the resilient leaf 9 by causing the slide member 10 located at the second position to move towards the inside of the insertion sections 21*c*.

In this embodiment, when the slide member 10 is located at its lowermost end, that is, the first position where ignition operation is impracticable, a spark will be made by operating the file 52 of the ignition means 5. However, it is impossible for the actuation lever 53 of the pressing means 6 to be depressed because the engagement recess 53*c* is engaged with the end 9*c* of the resilient leaf 9 which is in a locked state. Therefore, no fuel gas is discharged from the nozzle 3, and ignition lock is effected.

On the other hand, when the gas lighter 50 is used, the slide member 10 is inwardly pressed in the same manner as in the first embodiment, so that the curved pawls 36 of the slide member are deformed. In this state, the slide member 10 is upwardly moved to the second position where the ignition operation is practicable along the slide grooves 21 while the engagement sections 34 of the slide member 10 are disengaged from the stopper 25 of the resilient leaf 9. When the slide member 10 is left in the second position for a long period of time, the resilient leaf 9 will not be deformed, and hence the ignition lock function will be maintained.

The actuation lever 53 is depressed from the second position to the first position while the file 52 is rotated by ignition operation in the state in which the ignition operation is practicable. Then, the slide member 10 deforms the resilient leaf 9 at the third position during the course of its travel from the second position to the first position by the inclined cam surface of the inclined portion 21*b*, and causes the same to be rendered in a lock released state. Thereby, fuel gas is discharged and ignited. In accordance with the depression of the actuation lever 53, the slide member 10 is moved to its lowermost position, that is, the first position, and the resilient leaf 9 automatically returns to the locked state.

Figure 11A:
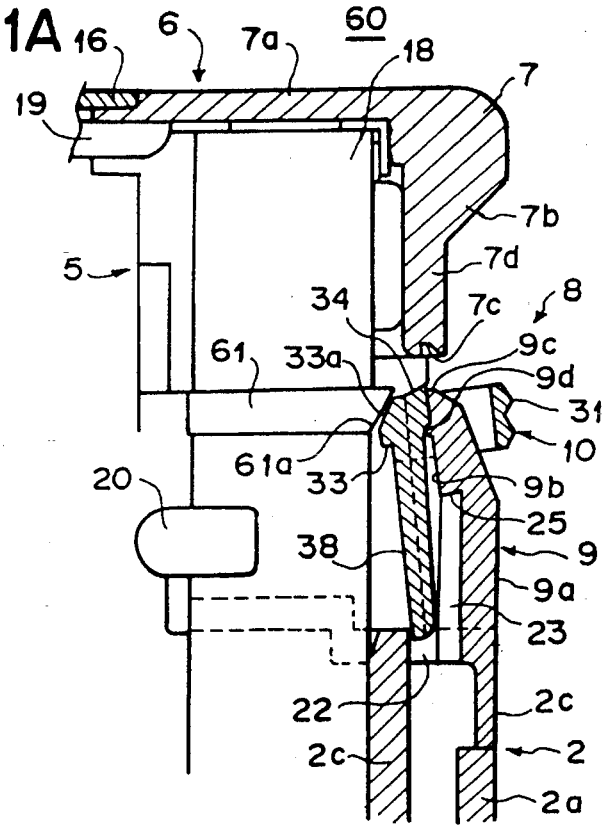
FIGS. 11A and 11B are longitudinal cross-sectional views showing chief elements of a gas lighter with a safety device according to a fourth embodiment of the present invention, wherein FIG. 11A corresponds to FIG. 7A and illustrates a slide member when it locates at a second position and FIG. 11B corresponds to FIG. 8A and illustrates the movement of the slide member and the deformation of a resilient leaf when an operation cap is pressed.
Figure 11B:
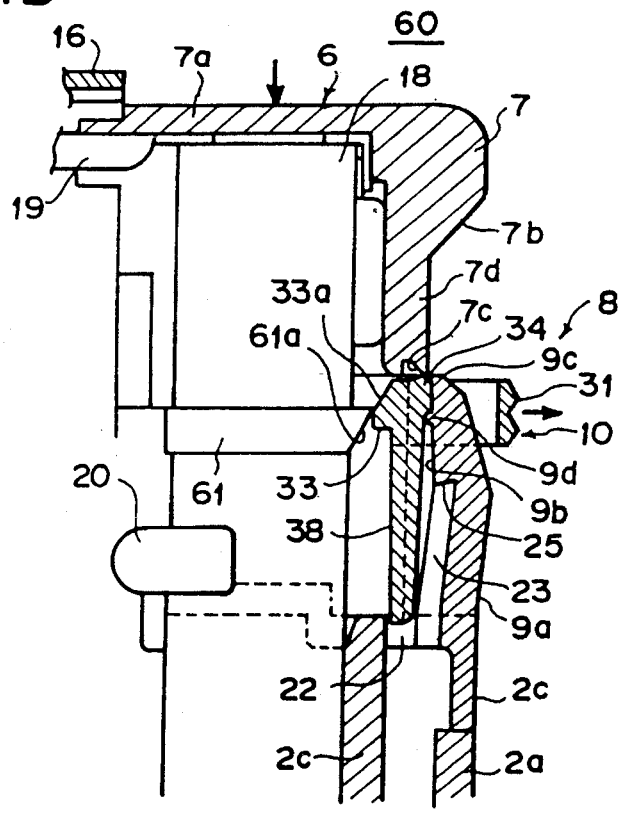

Fourth Embodiment:

FIGS. 11A and 11B show an electric discharge ignition type gas lighter 60 with a safety device according to a fourth embodiment, and this gas lighter 60 is an example in which a cam surface for forcing the resilient leaf 9 by means of the slide member 10 is formed in a member which moves in response to the action of the pressing means 6.

The lighter main body 2 which is the main structure of the gas lighter 60, the fuel supply means 4, the ignition means 5 having the piezoelectric unit 18, the pressing means 6, and the operation cap 7 are of the same construction of those in the first embodiment, and hence the same reference numerals are provided to designate the corresponding features.

The safety mechanism 8 for locking or releasing the action of the pressing means 6 is made up of the resilient leaf 9, the slide member 10 and an operation member 61. The operation member 61 is composed of a tapered surface 61*a* that acts as a cam surface and is fixed to a movable portion of the piezoelectric unit 18 which moves as a result of the depression of the operation cap 7 of the pressing means 6.

On the other hand, an inclined receiving surface 33*a* that can come into contact with the tapered surface 61*a* of the operation member 61 is formed on the inner side of the slide member 10 which is vertically movable along the resilient leaf 9. Other structures of this slide member 10 and the structure of the resilient leaf 9 are the same as those of the first embodiment. However, a protuberance 9*d* is horizontally formed on the contact surface 9*b* of the resilient leaf 9 that holds and meshes with the slide member 10.

In this embodiment, grooves (not shown) corresponding to the slide grooves 21 of the first embodiment are made on both sides of the resilient leaf 9. The slide grooves of this embodiment will be explained in terms of FIG. 1. Specifically, the slide grooves do not have the intermediate inclined portions 21*b*, but have the deformation suppressing means 11 constituted by the connection of the insertion section 21*c*, having a wider width, to the top of the lower portion 21*a*, having a narrower width. When the slide member 10 is moved to the position of the insertion section 21*c* (the second position), the pawls 36 on both sides are inserted into slide grooves of the insertion sections 21*c*, and the slide member is moved to the inside of the gas lighter, whereby the amount of deformation of the resilient leaf 9 is reduced.

The operation of the gas lighter with the safety device according to this embodiment will now be described. FIG. 11A corresponds to an operating state of the gas lighter shown in FIG. 7B, and FIG. 11B corresponds to an operating state of the gas lighter shown in FIG. 8A. When the slide member 10 is located in its lowermost position, that is, the first position, the end 9*c* of the resilient leaf 9 engages with the engagement recess 7*c* when the operation cap 7 is depressed, namely, the resilient leaf 9 is in an ignition-locked state.

When the gas lighter 30 with the safety device is used, the actuation lug 31 is thrust upwards while being inwardly pressed. In the same manner as in the first embodiment, the slide member 10 thus inwardly pressed is deformed in such a way that the ends of the pawls 36 extend widely, and then the slide member 10 moves. The engagement section 34 is inwardly disengaged from the stopper 25, and the slide member 10 upwardly moves to its uppermost position, that is, the second position as shown in FIG. 11A. At this time, the slide member 10 is sandwiched between the protuberance 9*d* of the resilient leaf 9 meshing with the lower end of the engagement section 34 and the tapered surface 61*a* of the operation member 61, and the slide member 10 is held in the second position.

Upon arrival at the second position, the slide member 10 is moved into the inside of the gas lighter, and the inclined surface 33*a* formed on the receiving section 33 comes into contact with the tapered surface 61*a* of the operation member 61. The inner surface of the engagement section 34 comes into contact with the contact surface 9*b* of the resilient leaf 9, and the engagement section 34 is held between the operation member 61 and the resilient leaf 9. In this second position where the ignition operation is practicable, the resilient leaf 9 remains non-deformed, and hence a lock function of the resilient leaf 9 will be maintained even if the resilient leaf 9 is left in this second position for a long period of time.

When the operation cap 7 is depressed to the first position for ignition purposes, the tapered surface 61*a* of the operation member 61 is lowered when the operation cap 7 arrives at the third position, and the tapered surface 61*a* thus lowered forces the inclined receiving surface 33*a* of the slide member 10 in such a way that the inclined receiving surface project outwards. As shown in FIG. 11B, the engagement section 34 of the slide member 10 forces the contact surface 9*b* of the resilient leaf 9 to the outside because of the forcing pressure of the tapered surface 61*a*. This causes the resilient leaf 9 to be deformed and rendered into a lock-released state, whereby depression of the operation cap 7 becomes possible.

Subsequent to this, the bottom of the operation cap 7 comes into contact with the engagement section 34, and the slide member 10 is forced down to the first position along the contact surface 9*b* in such a way as to go over the protuberance 9*d* of the contact surface 9*b*. Together with this, the fuel supply means 4 and the ignition means 5 are actuated, and ignition is carried out. Upon release of a finger from the operation cap 7, the gas lighter automatically returns to its initial ignition locked state.

In the above embodiment, the inclined surfaces that serve as a cam surface are formed on both the operation member 61 and the receiving section 33, but it may be possible to make this cam surface on only one of either the operation member 61 or the receiving section 33.

Figure 12A:
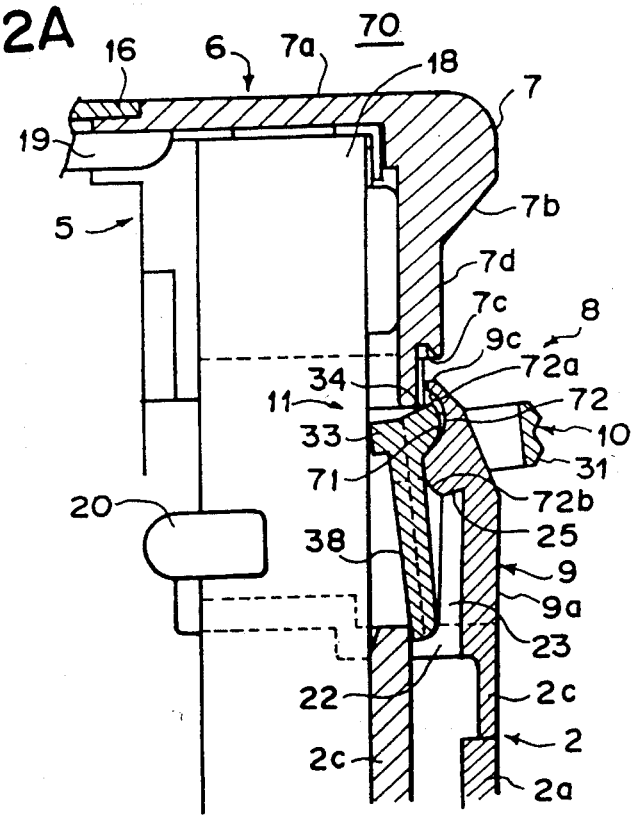
FIGS. 12A and 12B are longitudinal cross-sectional views showing chief elements of a gas lighter with a safety device according to a fifth embodiment of the present invention, wherein FIG. 12A corresponds to FIG. 7B and illustrates a slide member when it locates at a second position and FIG. 12B corresponds to FIG. 8A and illustrates the movement of the slide member and the deformation of a resilient leaf when an operation cap is pressed.
Figure 12B:
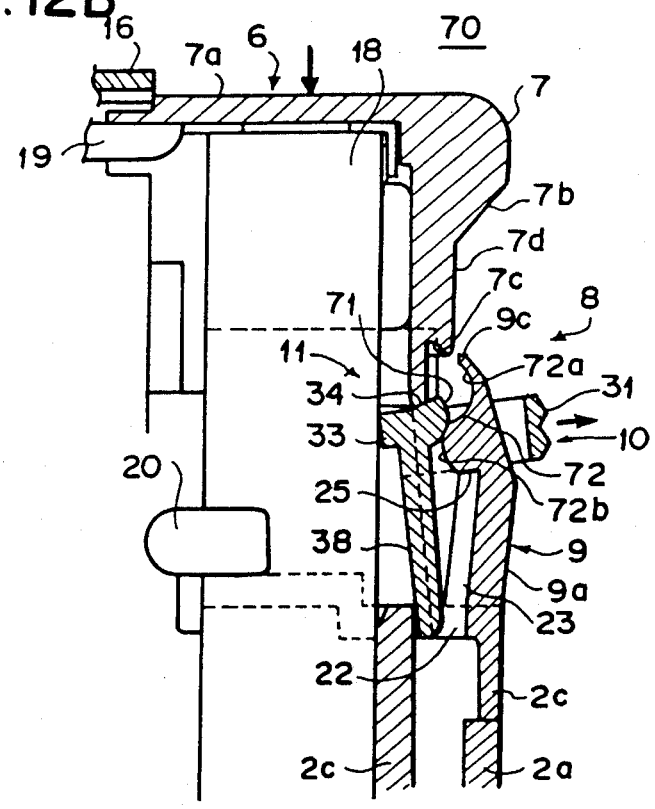

Fifth Embodiment:

FIGS. 12A and 12B show an electric discharge type gas lighter 70 with a safety device of this embodiment, and this is an example in which the deformation suppressing means 11 and the cam surface which forces the resilient leaf 9 by means of the slide member 10 are formed at a contact area between the slide member 10 and the resilient leaf 9.

The basic structure of the gas lighter 70 is the same as that in the previous embodiment, and the same reference numerals are provided to designate the corresponding features. The safety mechanism 8 for locking or releasing the operation of the pressing means 6 is constituted of a curved pressing surface 71 formed on an inner surface of the engagement section 34 of the slide member 10, and a curved slide contact surface 72 formed between the end 9*c* of the resilient leaf 9 and the stopper 25.

Specifically, the curved slide contact surface 72 of the resilient leaf 9 is divided into two subdivisions: namely; an upper part of the curved slide contact surface 72 is formed into a recessed surface 72*a* that constitutes the deformation suppressing means 11; and a lower part of the same is formed into a projecting surface 72*b* that constitutes a cam surface. A curved pressing surface 71 of the slide member 10 is formed into a projecting surface that fits to the recessed surface 72*a* of the curved slide contact surface 72. Here, the size of the slide member 10 is set in such a way that the end surface of the receiving section 33 comes into a side surface of the piezoelectric unit 18 while the curved pressing surface 71 is fitted to the recessed surface 72*a* of the curved slide contact surface 72.

In this embodiment, slide grooves (not shown) corresponding to the slide grooves 21 of the first embodiment are made on both sides of the resilient leaf 9. The slide grooves of this embodiment may be explained in terms of FIG. 1. Specifically, the slide grooves have neither the intermediate inclined portions 21*b* nor the insertion portions 21*c*, and the lower portions 21*a* having a narrow width are extended to the upper end of the slide grooves.

The operation of the gas lighter 70 with the safety device of this embodiment will now be described. FIG. 12A corresponds to an operating state of the gas lighter shown in FIG. 7B, and FIG. 12B corresponds to an operating state of the gas lighter shown in FIG. 8A. When the slide member 10 is located at its lowermost position, that is, the first position, the end 9*c* of the resilient leaf 9 engages with the engagement recess 7*c* even when the operation cap 7 is depressed, namely, the resilient leaf 9 is in an ignition-locked state.

When the gas lighter 70 with the safety device is used, the actuation lug 31 is thrust upward while being inwardly pressed. The slide member 10 thus inwardly pressed is deformed in such a way that the ends of the pawls 36 on both sides of the slide member 10 extend widely, and the slide member 10 then moves. The engagement section 34 is inwardly disengaged from the stopper 25, and the slide member 10 upwardly moves to its uppermost position, that is, the second position as shown in FIG. 12A. At this time, when the engagement section 34 is disengaged from the stopper 25, and when the slide member 10 moves upwards, the curved pressing surface 71 goes over the projecting surface 72*b* of the curved slide contact surface 72. The end surface of the receiving section 33 of the slide member 10 comes into contact with the side surface of the piezoelectric unit 18, and hence the receiving section 33 will no longer move towards the inside of the gas lighter any more. As a result of this, the resilient leaf 9 is temporarily deformed towards the outside, and the slide member 10 moves upwards further.

Upon arrival of the slide member 10 at the second position, the curved pressing surface 71 of the slide member 10 fits into the recessed surface 72*a* of the curved slide contact surface 72. Thereby, the amount of deformation of the resilient leaf 9 is reduced, and the slide member 10 is held by the resilient leaf 9 so as not to fall. Since the amount of deformation of the resilient leaf 9 at this second position where ignition operation is practicable is reduced, the resilient leaf 9 will not be deformed even if it is left in that position for a long period of time, and hence its lock function will be maintained.

When the operation cap 7 is depressed to the first position for ignition purpose, the lower end of the operation cap 7 thus lowered comes into contact with the slide member 10 at the third position in an initial stage, and hence the slide member 10 is forced to extend. Thereby, the curved pressing surface 71 moves from the recessed surface 72*a* of the curved slide contact surface 72 in such a way that it comes into slidable contact with the projection surface 72*b* below the recessed surface 72*a*. As a result of this, the resilient leaf 9 is forced so as to project to the outside. As shown in FIG. 12B, this pressing force causes the resilient leaf 9 to be deformed and rendered in a lock-released state, whereby the depression of the operation cap 7 becomes possible.

Further depression of the operation cap 7 causes the curved pressing surface 71 of the slide member 10 to go over the projecting surface 72*b*, and hence the slide member 10 is depressed to its lowermost position, that is, the first position. Together with this, the fuel supply means 4 and the ignition means 5 are actuated, and ignition is carried out. Upon release of a finger from the operation cap 7, the gas lighter automatically returns to its initial ignition-locked state.

Sixth Embodiment:

FIGS. 13A and 13B show an electric discharge type gas lighter 80 with a safety device of this embodiment. In contrast with the gas lighter 1 of the first embodiment, which has an oval cross section, in this embodiment, a gas lighter having a rectangular cross section is provided with the safety mechanism 8 similar to that of the previous embodiments. Although there may be a certain difference in shape, the same reference numerals are provided to designate the corresponding features.

The lighter main body 2 of the gas lighter 80 is rectangularly cylindrical, and hence the operation cap 7 is also rectangular corresponding to the shape of the lighter main body 2. The safety mechanism 8 is formed along the flat end surface of the lighter body. Other basic structures, that is, the fuel supply means 4, the ignition means 5 and the pressing means 6 are of the same constitution as those of the first embodiment.

The engagement recess 7*c* is made in the lower rear end of the sidewall 7*b* of the operation cap 7 which is on the opposite side to the windproof cap 16. The resilient leaf 9, which extends vertically, is formed on the end face of the intermediate case 2*c* of the lighter body 2 in an integrated fashion. The slide grooves 21 on both sides of this resilient leaf 9 have a width corresponding to that of the link section 32 of the slide member 10, and the width of the grooves 32 is constant throughout the length of the grooves. Insertion sections 81 that constitute the deformation suppressing means 11 in a recessed way, and inclined surfaces 82 that constitute a cam surface are formed on both sides of an upper part of the slide grooves 21.

The slide member 10 is provided with the operation lug 31 that extends laterally, and the flexible curved pawls 36 that can extend widely are connected to both ends of the operation lug 31. These pawls 36 can come into contact with the exterior side surface of the intermediate case 2*c* below the slide grooves 21, and can also come into contact with the insertion section 81 and the inclined surfaces 82 on the upper part of the slide grooves 21. The link sections 32 of the slide member 10 slidably move along the slide grooves 21 in the same manner as in the first embodiment, and the lower end of the operation cap 7 comes into contact with an upper surface of the inner receiving section 33.

Protuberances 7*e* which extend vertically are formed on both sides of the engagement recess 7*c* of the operation cap 7, and these protuberances 7*e* travel along the slide grooves 21 in response to the vertical movement of the operation cap 7.

The insertion sections 81 are recessed in a direction opposite to the direction of deformation of the resilient leaf 9. When the slide member 10 is located at its uppermost location, that is, the second position where ignition operation is practicable, the pawls 36 on both sides of the slide member 10 are inserted into the insertion sections 81, which makes the resilient leaf 9 non-deformed. At the third position during the course of the travel of the slide member 10 from the second position to the first position, the pawls 36 come into contact with the inclined surfaces 82, and the slide member 10 is displaced towards the outside, whereby the resilient leaf 9 is deformed and rendered in a lock-released state.

The operation of the gas lighter of this embodiment is substantially the same as that in the first embodiment. FIG. 13A corresponds to a state of the gas lighter shown in FIG. 1 in which the slide member 10 is located at the first position, and FIG. 13B corresponds to an operating state shown in FIG. 5B in which the slide member 10 is located at the second position.

Seventh Embodiment:

FIGS. 14, 15, 16A and 16B show an electric discharge type gas lighter 90 with a safety device of this embodiment. In each of the previous embodiments, the resilient leaf 9 is provided on the lighter main body 2, and the resilient leaf 9 is designed to engage with the engagement recess 7*c* of the operation cap 7 of the pressing means 6. Contrary to this, in this embodiment, the resilient leaf 9 is provided on the operation cap 7 of the pressing means 6, and it is arranged in such a way that the end of the resilient leaf 9 engages with a part of the intermediate case 2*c* of the lighter main body 2. The gas lighter 90 of this embodiment has the same rectangular cross section as the gas lighter of the sixth embodiment. Although there may be a certain difference in shape, arrangement and location for each member, the same reference numerals are provided to designate the corresponding features.

The safety mechanism 8 of the gas lighter 90 is made up of the resilient leaf 9 and the slide member 10. The resilient leaf 9 is formed into a flat end face in the same manner as in the previous embodiment. This resilient leaf 9 extends vertically and has the same shape as that of the previous embodiment, and the upper end thereof is fixed to the bottom of the operation surface 7*a*. The slide grooves 21 are made on both sides of the resilient leaf 9. Moreover, an engagement recess 91 that engages with the end 9*c* of the resilient leaf 9 is formed in an end face portion of the intermediate case 2*c* of the lighter main body 2.

The slide member 10 is inserted into the slide grooves 21 on both sides of the resilient leaf 9, and are vertically movable along this resilient leaf 9. The slide member 10 of this embodiment is the same in constitution as that of the previous embodiment for the operation lug 31, the receiving section 33 and the pawls 36, except for the removal of the leg 38 from the slide member 10. However, these members, that is, the operation lug 31, the receiving section 33 and the pawls 36 are disposed upside down compared to the previous embodiments.

Insertion sections 92 that constitute the deformation suppressing means 11 in a recessed manner are formed on both sides and in a lower portion of the slide grooves 21, and inclined surfaces 93 that constitute a cam surface are formed above the insertion sections 92.

The pawls 36 of the slide member 10 can come into contact with the side exterior surface of the operation cap 7 above the slide grooves 21, and can also come into contact with the insertion sections 92 and the inclined surfaces 93 in the lower portion of the slide grooves 21. The link sections 32 of the slide member 10 slidably travel along the slide grooves 21, and the upper end of the intermediate case 2*c* comes into contact with the lower surface of the inner receiving section 33.

The insertion sections 92 are formed in a recessed way in a direction opposite to the direction of deformation of the resilient leaf 9. When the slide member 10 is located at its lower most position, that is, the second position where ignition operation is practicable, the pawls 36 on both sides are inserted into the insertion sections 92, which makes the resilient leaf 9 non-deformed (see FIG. 16A). At the third position during the course of the travel of the slide member 10 from the second position to the first position (see FIG. 16B), the pawls 36 come into contact with the inclined surfaces 93, which in turn displaces the slide member 10 towards the outside. Thus, the resilient leaf 9 is deformed towards the outside and rendered in a lock-released state.

Figure 14:
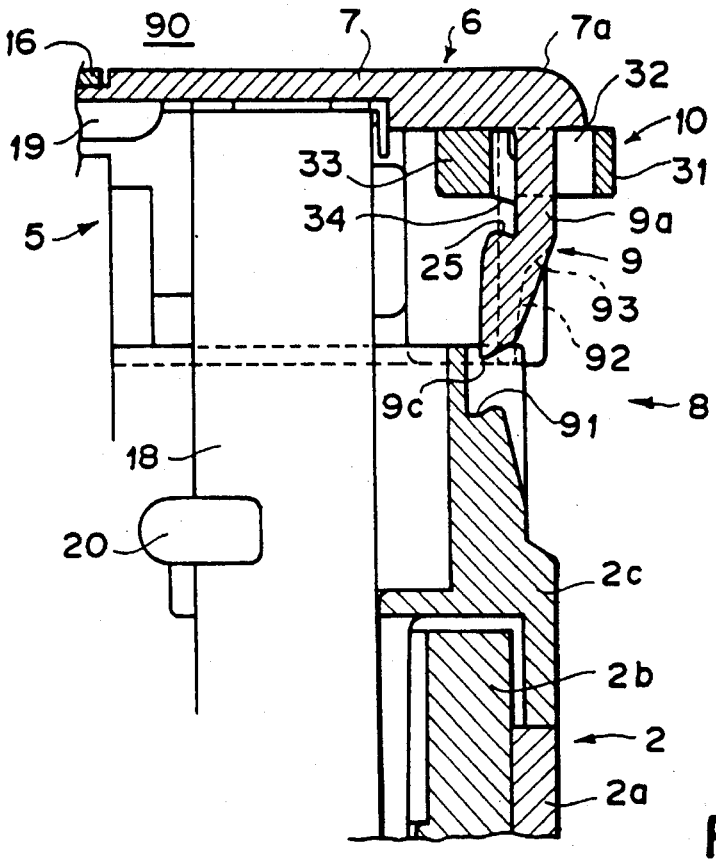
FIG. 14 is a longitudinal cross-sectional view showing a gas lighter with a safety device according to a seventh embodiment of the present invention.
Figure 15:
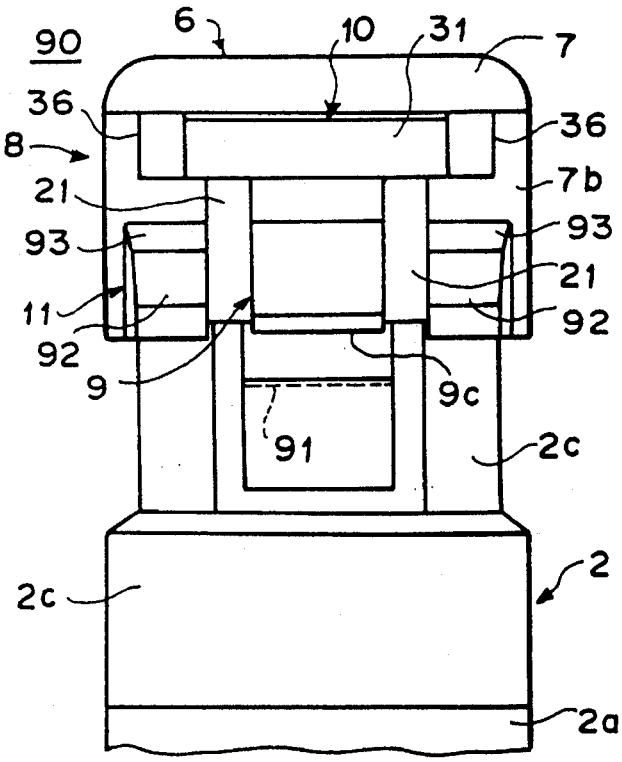
FIG. 15 is a side elevation view showing chief elements of the gas lighter with the safety device shown FIG. 14.
Figure 16A:
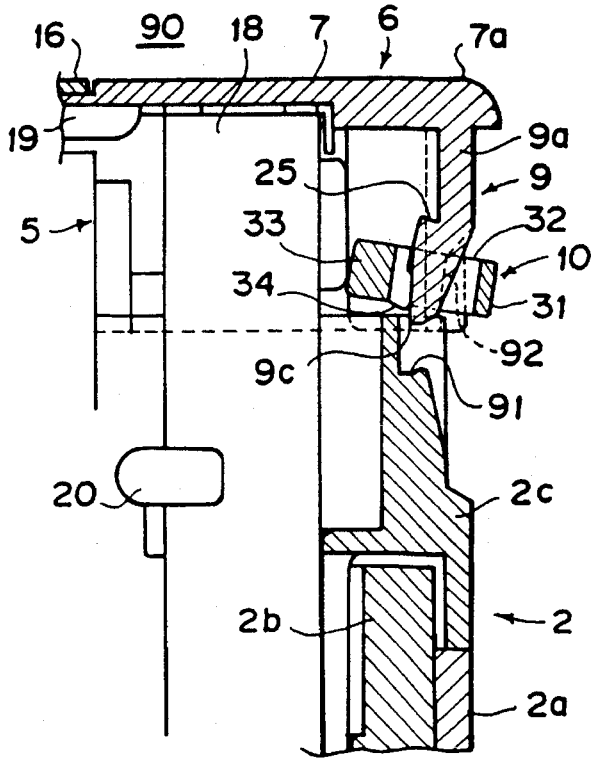
Figure 16B:
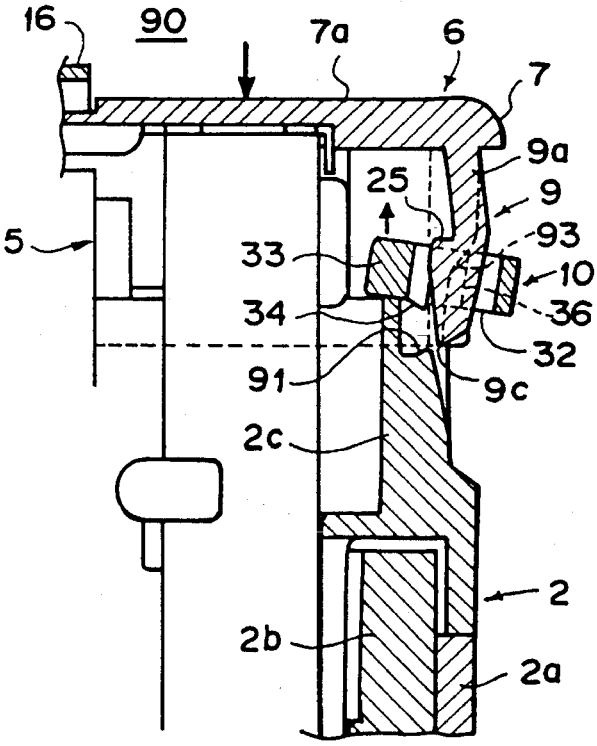

The operation of the gas lighter 90 of this embodiment is substantially the same as that of the sixth embodiment. FIGS. 14 and 15 correspond to a state of the gas lighter shown in FIG. 13A in which the slide member 10 is located at the first position, and FIG. 16A corresponds to an operating state of the gas lighter shown in FIG. 13B in which the slide member 10 is located at the second position. The slide member 10, thus moved to the second position where ignition operation is practicable, is inserted into the insertion sections 92 in the manner as mentioned above. Thus, the resilient leaf 9 remains non-deformed, and hence a lock function of the resilient leaf 9 will be maintained even when the gas lighter is left in this state for a long period of time.

Eighth Embodiment:

FIGS. 17, 18, 19A, 19B, 19C, 20A, 20B, and 20C show a gas lighter 100 with a safety device according to this embodiment. In this embodiment, the resilient leaf 9 is disposed on the pressing means 6 and is arranged in such way that the end of the resilient leaf 9 meshes with a part of the lighter main body 2 in the same manner as in the seventh embodiment. In contrast with the fact that the slide member 10 is fitted around the resilient leaf 9 in the previous embodiment, the slide member 10 is disposed on the lighter main body 2 in this embodiment. Although there may be a certain difference in shape, arrangement and location, the same reference numerals are provided to designate the corresponding features.

Figure 19A:
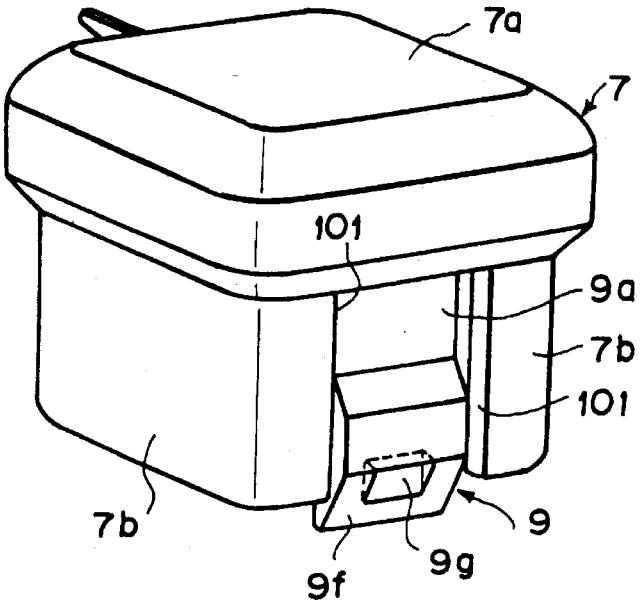

The safety mechanism 8 of the gas lighter 100 is made up of the resilient leaf 9 and the slide member 10. As shown in FIG. 19A, the resilient leaf 9 that extends vertically is formed in the sidewall 7*b* of the operation cap 7, and longitudinal grooves 101 are made on both sides of the resilient leaf 9. This resilient leaf 9 extends from its thick base portion 9*a* on an upper portion thereof, and a lower portion of the same is formed bulging towards the outside. A contact surface 9*f* is formed on the lower end of the bulged portion of the resilient leaf 9. An engagement recess 9*g* is formed substantially at the center of this contact surface 9*f*, and the contact surface 9*f* is formed at an inclined angle so as to partially surround the engagement recess 9*g*.

Figure 19C:
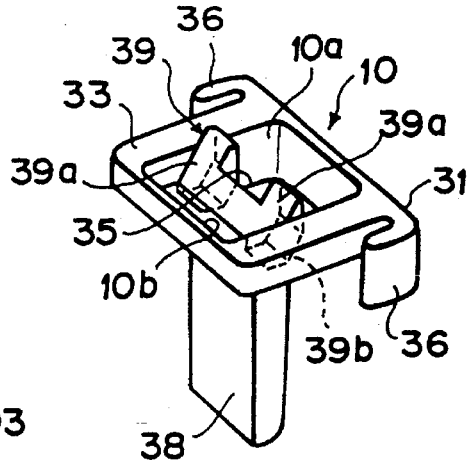
Figure 19B:
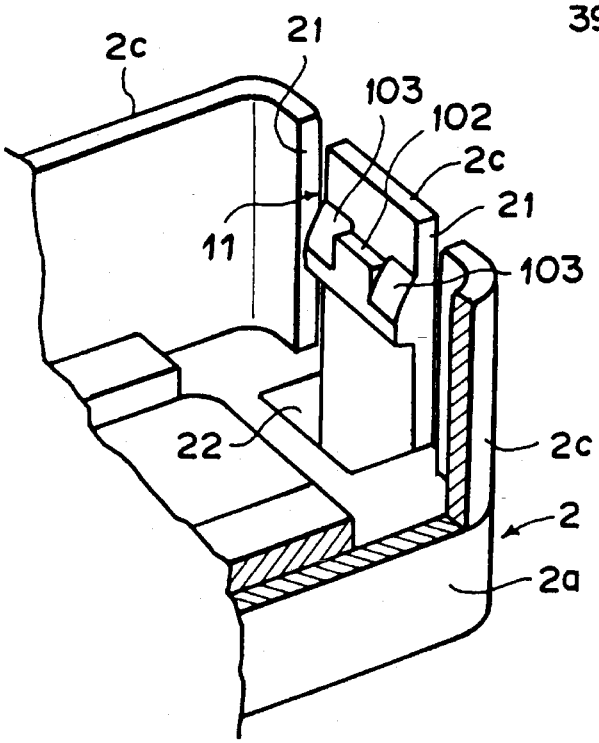

An engagement projection 102 which engages with the engagement recess 9*g* of the resilient leaf 9 is formed on the inner surface of the sidewall of the intermediate case 2*c* of the lighter main body 2 as shown in FIG. 19B. Inclined surfaces 103 that correspond to the contact surface 9*f* of the resilient leaf 9 are formed in such a way that they are less inclined towards the inner surface of the sidewall at their upper ends. The slide grooves 21 are formed vertically on both sides of these inclined surfaces 103.

As shown in FIG. 19C, the slide member 10 is inserted in the slide grooves 21 formed in the intermediate case 2*c* in such a way that it is vertically movable. This slide member 10 is provided with the operation lug 31, and the pawls 36 that come into contact with the exterior surface of the intermediate case 2*c* outside the slide grooves 21 are connected to both ends of the operation lug 31. The receiving section 33, which is passed through the slide grooves 21 and with which the lower end of the operation cap 7 comes into contact, is connected to the operation lug 31, whereby rectangular spaces are formed between the receiving sections 33 and the pawls 36.

A part of the intermediate case 2*c* defined between the slide grooves 21 is inserted into the opening 10*a* formed in the slide member 10. A pressing section 39 is formed in the opening 10*a* together with the receiving section 33. A lower part of this pressing section 39 is formed into the leg 38 that extends downwardly in an integrated fashion. An upper surface of the pressing section 39 is formed into an upper inclined guide surface 39*a* that corresponds to the contact surface 9*f* of the resilient leaf 9. The longitudinal groove 35 into which the engagement projection 102 of the intermediate case 2*c* can be inserted is formed into the leg 38 at the center part of the upper inclined guide surface 39*a* that faces the operation lug 31. Moreover, lower inclined guide surfaces 39*b* that correspond to the inclined surfaces 103 of the intermediate case 2*c* are formed on both sides of a part of the longitudinal groove 35 of the pressing section 39 that faces the operation lug 31. In addition, an opening 10*b* that allows the insertion of the lower end of the resilient leaf 9 is formed on the opposite side to the opening 10*a* with the pressing section 39 sandwiched between these two openings.

In the intermediate case 2*c*, only the engagement projection 102 and the inclined surfaces 103 on both sides of the projection 102 are formed so as to project inwardly. An upper part of the sidewall above these elements is thinly formed, and hence the deformation suppressing means 11 for alleviating the amount of deformation of the resilient leaf 9 by the use of the pressing section 39 of the slide member 10 is constituted.

Figure 17:
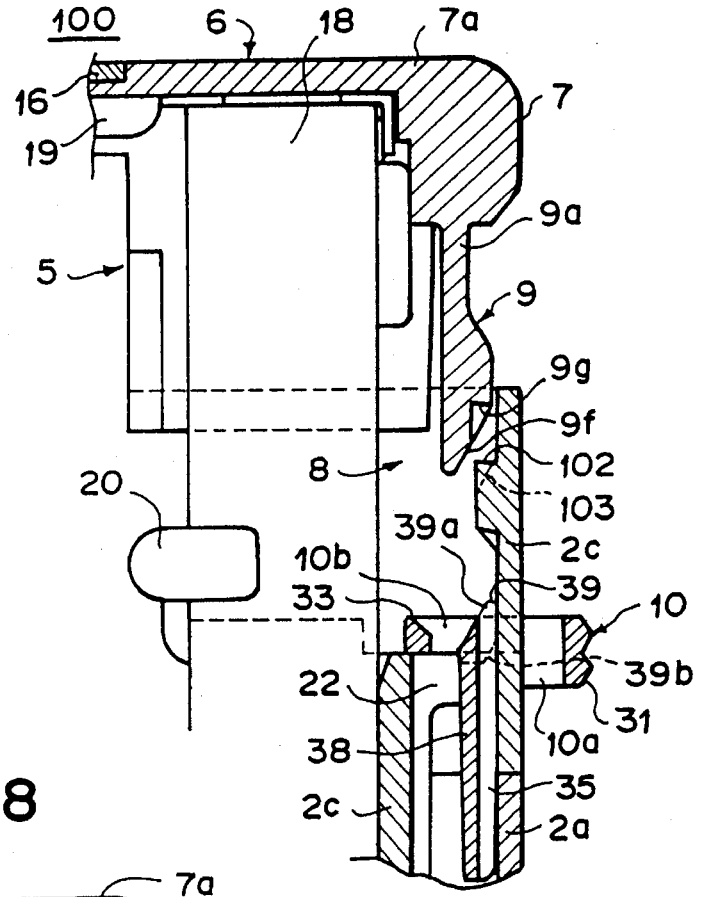
FIG. 17 is a longitudinal cross-sectional view showing chief elements of a gas lighter with a safety device according to an eighth embodiment of the present invention.
Figure 18:
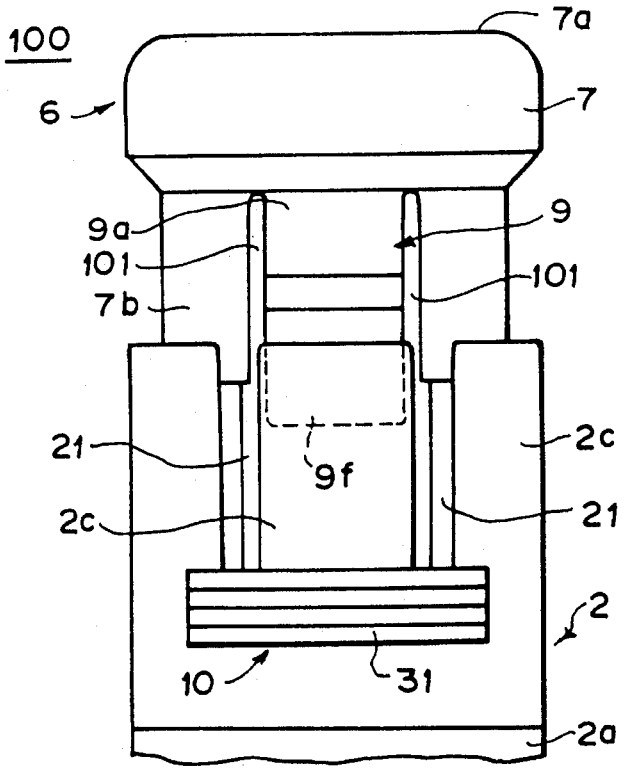
FIG. 18 is a side elevation view showing chief elements of the gas lighter with the safety device shown in FIG. 17.

The operation of the gas lighter with the safety device of this embodiment will now be described. As shown in FIGS. 17 and 18, when the slide member 10 is located at the lower end of the slide grooves 21, that is, the first position where ignition operation is impracticable, the resilient leaf 9 is in a non-deformed state (a locked state). When the operation cap 7 is depressed, the engagement projection 102 of the intermediate case 2 engages with the engagement recess 9*g* of the resilient leaf 9, and interrupts the operation cap 7. This makes further depression of the operation cap 7 impossible, and the gas lighter is rendered in an ignition-locked state.

When the gas lighter 100 is used, the operation lug 31 of the slide member 10 is thrust upwards to the second position while being pressed towards the inside of the gas lighter. Specifically, when the slide member 10 is pressed towards the inside of the gas lighter, the ends of the pawls 36 on both sides come into contact with the exterior surface of the intermediate case 2*c*, and the pawls 36 are deformed so as to extend widely. As a result of this, the slide member 10 is displaced towards the inside of the gas lighter, and the crest of the pressing section 39 is disengaged from the lower end of the inclined surfaces 103 of the intermediate case 2*c*. Then, the slide member 10 is disengaged from the inclined surfaces 103 to the inside of the gas lighter, and hence it becomes movable to the upper end of the slide grooves 21.

Figure 20A:
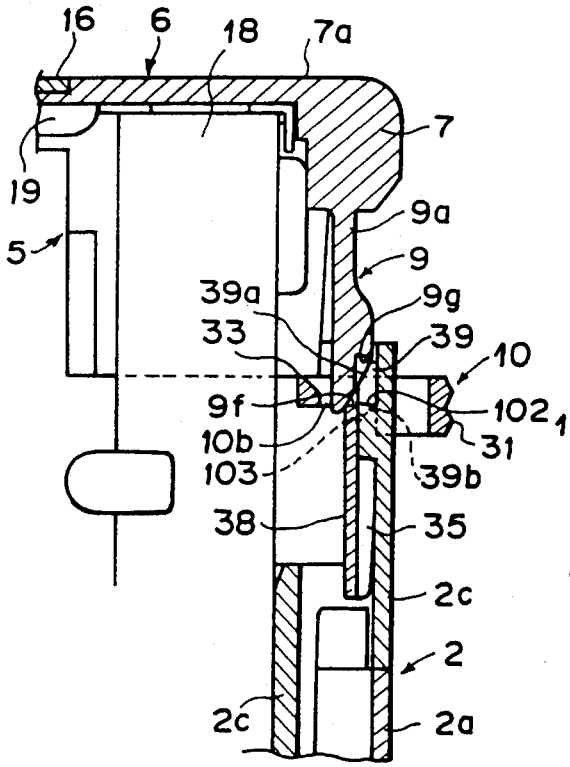

Upon arrival of the slide member 10 at the second position, the lower inclined guide surfaces 39*b* of the pressing section 39 come into contact with the inclined surfaces 103 as shown in FIG. 20A. As a result of this, the slide member 10 is displaced towards the outside, and the resilient leaf 9 remains non-deformed. Therefore, even when the gas lighter is left in this state for a long period of time, the resilient leaf 9 will not be plastically deformed into a shape which makes it impossible for the engagement recess 9*g* of the resilient leaf 9 to mesh with the engagement projection 102 of the intermediate case 2*c*, and hence a lock function of the gas lighter is maintained. Here, when the slide member 10 is thrust upwards while being pressed, the upper inclined guide surface 39*a* comes into contact with the contact surface 9*f* of the resilient leaf 9, and the resilient leaf 9 is temporarily deformed.

Figure 20B:
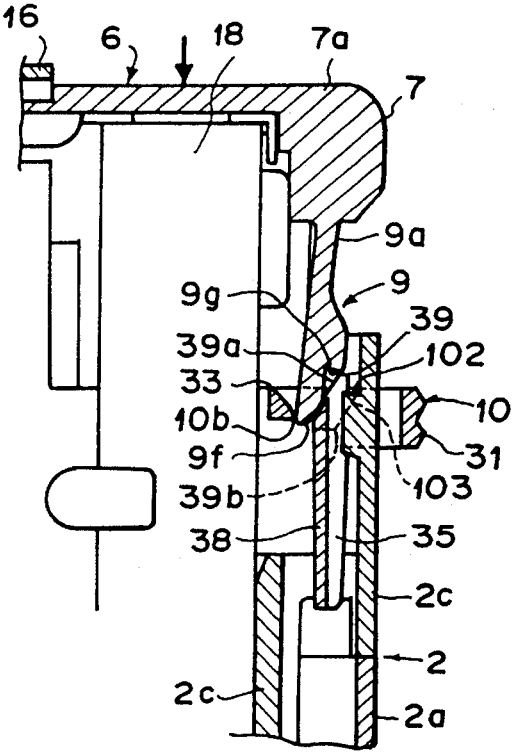
Figure 20C:
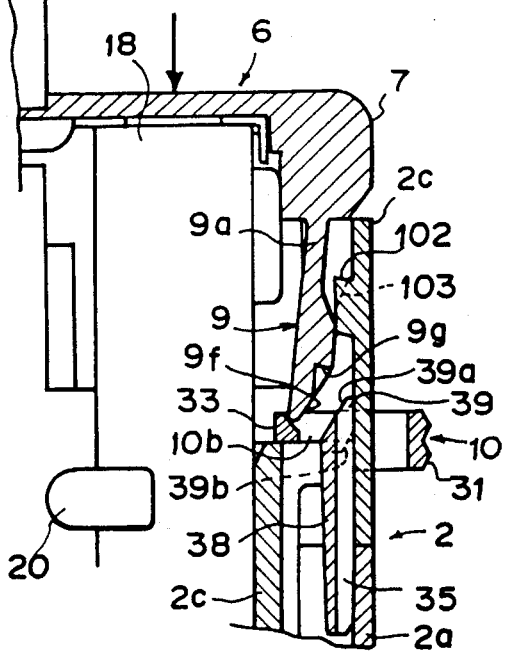

When the operation cap 7 is depressed for ignition purposes, the lower end of the operation cap 7 comes into contact with the receiving section 33, and the slide member 10 is lowered together with the operation cap 7. As shown in FIG. 20B, at the third position in an initial stage, the slide member 10 is subjected to a force which causes the slide member 10 towards the inside of the gas lighter because the lower inclined guide surfaces 39*b* of the slide member 10 are lowered along the inclined surfaces 103 (a cam surface) of the intermediate case 2*c*. Because of this pressing force, the upper inclined guide surfaces 39*a* of the slide member 10 act so as to press the contact surface 9*f* of the resilient leaf 9. As a result of this, the resilient leaf 9 is deformed and rendered in a lock-released state, which makes it impossible for the engagement recess 9*g* to mesh with the engagement projection 102 of the intermediate case 2*c*. This makes the depression of the operation cap 7 possible, and ignition operation is performed. Together with this, the slide member 10 is also lowered, and it goes over the engagement projection 102 of the intermediate case 2*c* and is lowered to the first position as shown in FIG. 20C.

Figure 21:
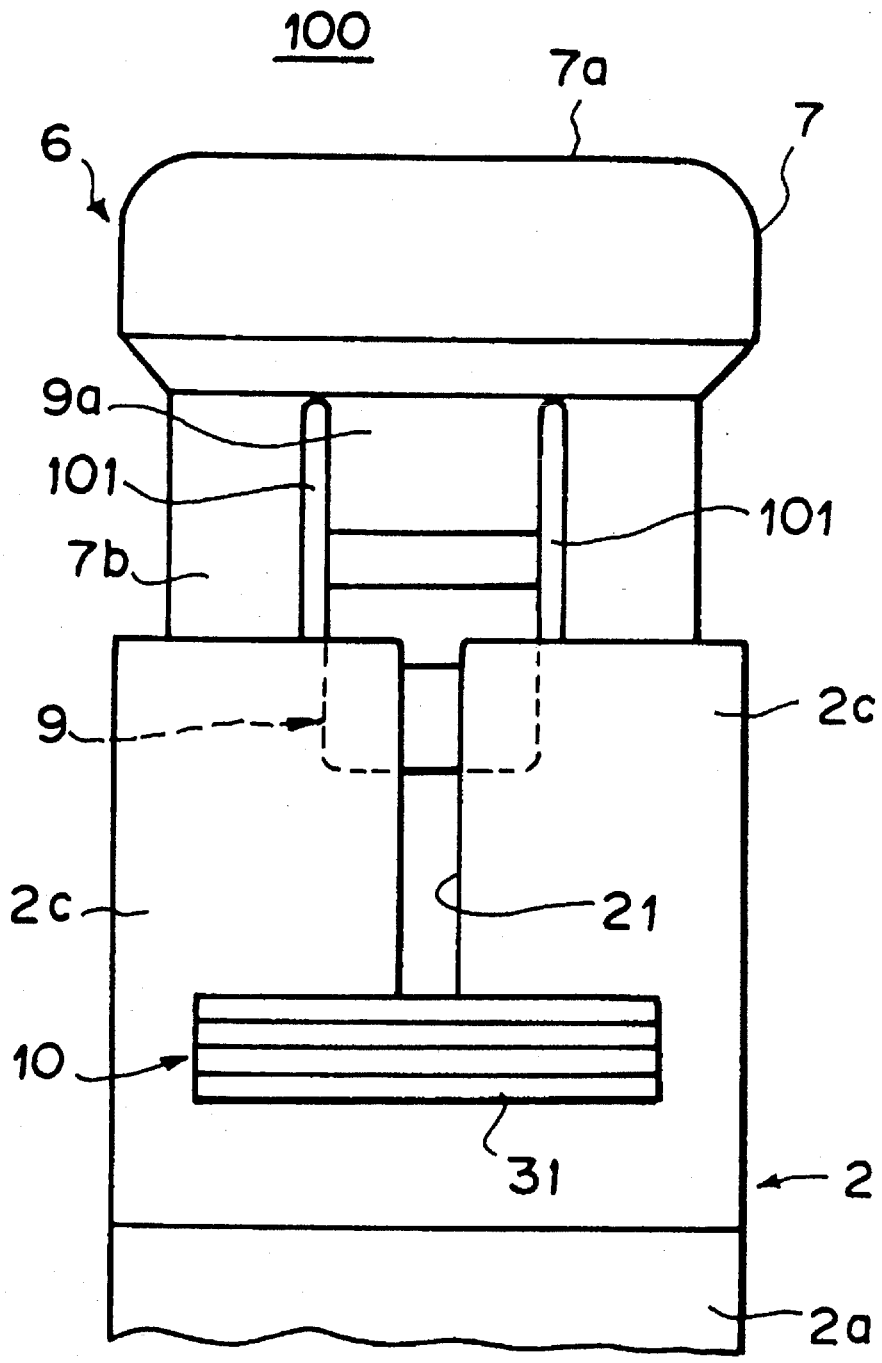
FIG. 21 is a side elevation view showing chief elements of a gas lighter with a safety device which is a modified example of the gas lighter of the eighth embodiment.

FIG. 21 shows a modified example of the gas lighter with the safety device of the eighth embodiment. In this gas lighter, one slide groove 21 is formed in the intermediate case 2*c*, and hence a detailed structure thereof is omitted here for brevity. The engagement projection 102 and the inclined surface 103 are formed on both sides or one side of the slide groove 21. In response to their positions, the shapes of the contact surface 9*f* and the engagement recess 9*g* of the resilient leaf 9 and the pressing section 39 of the slide member 10 are modified, and effects similar to those obtained by the previous embodiments are obtained.

The deformation suppressing means 11 reduces the amount of deformation of the resilient leaf 9 caused by the slide member 10 located at the second position to the amount obtained when the resilient leaf 9 is substantially non-deformed. The amount of deformation of the resilient leaf obtained when the slide member 10 is located at the second position should only be reduced so as to be lower than that obtained when the slide member located at the third position. It is desirable that the amount of deformation of the resilient leaf obtained when the slide member is located at the second position be reduced to the range where the end 9*c* or the engagement recess 9*g* can engage with the engagement recess 7*c* of the operation cap 7 or the engagement projection 102 of the intermediate case 2*c*. It is more desirable that the amount of deformation be reduced to the amount obtained when the resilient leaf is non-deformed.

The basic idea of the gas lighter with the safety device in each of the previous embodiments resides in a safety mechanism in which the resilient leaf 9 which produces an ignition lock state when it is in a non-deformed state is deformed into a lock-released state by means of the slide member 10, and more particularly in the reduction of the amount of deformation of the resilient leaf 9 obtained when the slide member 10 is located at the position where ignition operation is practicable.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to persons who are versed in the art.

What is claimed is:

1. A gas lighter with a safety device comprising:

a lighter main body in which fuel gas is stored;

a fuel supply means for supplying the fuel gas stored in the lighter main body;

a pressing means for opening a fuel path to the nozzle in the fuel supply means;

a resilient leaf deformable between a locked state in which the depression of the pressing means is prevented and a lock released state in which the operation of the pressing means is allowed;

a slide member movable with respect to the resilient leaf to cause the resilient leaf to be deformed from the locked state to the lock released state; and a deformation suppressing means that reduces the amount of deformation of the resilient leaf caused by the slide member when the slide member is located at a location where ignition operation is practicable so as to be less than the amount of deformation of the resilient leaf obtained when the slide member is in the lock released state.

2. A gas lighter with a safety device comprising:

a lighter main body in which fuel gas is stored;

a fuel supply means for supplying the fuel gas stored in the lighter main body to a nozzle;

an ignition means for igniting the fuel gas discharged from the nozzle;

a pressing means movable to an ignition position for opening a fuel path to the nozzle in the fuel supply means as a result of a pressing operation;

a resilient leaf that is deformable between a locked state where the depression of the pressing means is prevented and a lock released state where the operation of the pressing means is allowed;

a slide member that is movable from a first position where ignition operation is impracticable when the resilient leaf is in the locked state to a second position where the ignition operation is practicable, and that causes the resilient leaf to be deformed and rendered in the lock released state at a third position which is reached during movement of the slide member from the second position to the first position in response to the ignition operation; and a deformation suppressing means that reduces the amount of deformation of the resilient leaf obtained when the slide member is located at the second position so as to be less than the amount of deformation of the resilient leaf in the lock-released state when the slide member is located at the third position, wherein the deformation suppressing means is made of a recessed insertion section that causes the slide member located at the second position to move in a direction opposite to a direction of deformation of the resilient leaf.

3. A gas lighter with a safety device as defined in claim 2, wherein the insertion section is formed in one of the lighter main body and the pressing means.

4. A gas lighter with a safety device as defined in claim 2, wherein the slide member is displaced by a cam surface in the gas lighter in accordance with the movement of the pressing means, which deforms the resilient leaf.

5. A gas lighter with a safety device as defined in claim 2, wherein the slide member engages with a part of one of the resilient leaf and the lighter main body during the course of the travel thereof from the first position to the second position by operation of a user, and the slide member thus engaging is displaced and disengaged by pressing the slide member to the inside of the gas lighter.

6. A gas lighter with a safety device as defined in claim 2, wherein a recess for reducing the amount of deformation of the resilient leaf is formed at the ignition position to which the pressing means is depressed.

7. A gas lighter with a safety device as defined in claim 2, wherein the deformation suppressing means is formed at an area where the slide member comes into contact with the resilient leaf.

8. A gas lighter with a safety device comprising:

a lighter main body in which fuel gas is stored;

a fuel supply means that supplies the fuel gas stored in the lighter main body to a nozzle;

an ignition means for igniting fuel gas discharged from the nozzle;

a pressing means movable to an ignition position for opening a fuel path to the nozzle in the fuel supply means by a depressing operation;

a resilient leaf that is formed in a plastically deformable manner in a part of one of the lighter main body and the pressing means, and that comes into contact with a part of the other of the pressing means and the lighter main body when in a non-deformed state and is also rendered in a locked state in which the resilient leaf prevents the depression of the pressing means, whereas the resilient leaf allows the operation of the pressing means when the resilient leaf is deformed and rendered in a lock released state;

a slide member which is movable between a first position where ignition operation is impracticable when the resilient leaf is in the locked state and a second position where the ignition operation is practicable, and which causes the resilient leaf to be deformed and rendered in the lock released state at a third position which is reached during movement of the slide member from the second position to the first position in response to the depression of the pressing means; and a deformation suppressing means that reduces the amount of deformation of the resilient leaf when the slide member is located at the second position so as to be less than the amount of deformation of the resilient leaf when the slide member is located at the third position and is in the lock release state, whereby the slide member causes the resilient leaf to be deformed and rendered in the lock released state in response to the movement of the pressing means, wherein the deformation suppressing means is made of a recessed insertion section that causes the slide member located at the second position to move in a direction opposite to a direction of deformation of the resilient leaf.

9. A gas lighter with a safety device as defined in claim 2, wherein the insertion section is formed in one of the lighter main body and the pressing means.

10. A gas lighter with a safety device as defined in claim 8, wherein the deformation suppressing means is formed at an area where the slide member comes into contact with the resilient leaf.

11. A gas lighter with a safety device as defined in claim 8, wherein the slide member is displaced by a cam surface in the gas lighter in accordance with the movement of the pressing means, which deforms the resilient leaf.

12. A gas lighter with a safety device as defined in claim 8, wherein the slide member engages with a part of one of the resilient leaf and the lighter main body during the course of the travel thereof from the first position to the second position by operation of a user, and the slide member thus engaging is displaced and disengaged by pressing the slide member to the inside of the gas lighter.

13. A gas lighter with a safety device as defined in claim 8, wherein the recess for reducing the amount of deformation of the resilient leaf is formed at the ignition position to which the pressing means is depressed.

* * * * *

UNITED STATES PATENT AND TRADEMARK OFFICE

CERTIFICATE OF CORRECTION

PATENT NO. : 5,458,482

DATED : October 17, 1995

INVENTOR(S) : Masaki Saito, et. al.

It is certified that error appears in the above-indentified patent and that said Letters Patent is hereby corrected as shown below:

Title page, item [73], Assignee: should read--Kanagawa--.
Column 2, line 62, "moved to" should read --moved--.
Column 6, line 8, "second position" should read --third position--.
Column 13, line 17, "FIGS. 10A and 10B" should read --FIG. 10--.
Column 21, line 18, "towards" should read --to move towards--.
Column 21, line 50, "member" should read --member is--.
Column 22, line 13, "body" should read --body to a nozzle--.
Column 24, line 19, "claim 2," should read --claim 8--.

Signed and Sealed this

Ninth Day of April, 1996

*Attest:*

Bruce Lehman

BRUCE LEHMAN

*Attesting Officer*

*Commissioner of Patents and Trademarks*